US007190921B2

(12) United States Patent
Ishii et al.

(10) Patent No.: US 7,190,921 B2
(45) Date of Patent: Mar. 13, 2007

(54) DEVELOPING CARTRIDGE, PHOTOSENSITIVE MEMBER CARTRIDGE, PROCESS UNIT, AND IMAGE FORMING APPARATUS

(75) Inventors: Makoto Ishii, Nagoya (JP); Takami Takeuchi, Nagoya (JP); Kazumasa Makino, Shenzhen (CN); Hirotaka Mori, Ichinomiya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 116 days.

(21) Appl. No.: 10/899,145

(22) Filed: Jul. 27, 2004

(65) Prior Publication Data

US 2005/0053394 A1 Mar. 10, 2005

(30) Foreign Application Priority Data

Jul. 31, 2003 (JP) ..... P2003-204737
Jul. 31, 2003 (JP) ..... P2003-204738

(51) Int. Cl.
*G03G 21/16* (2006.01)

(52) U.S. Cl. ..... 399/111

(58) Field of Classification Search ..... 399/107, 399/110, 111, 113, 116, 119
See application file for complete search history.

(56) References Cited

U.S. PATENT DOCUMENTS 5,650,841 A * 7/1997 Matsuda et al. ..... 399/111
6,041,203 A * 3/2000 Suzuki et al. ..... 399/111
6,377,765 B1 4/2002 Shishido et al.
6,751,428 B2 6/2004 Okabe
6,836,629 B2 * 12/2004 Miyabe et al. ..... 399/111
2002/0181969 A1 12/2002 Terada et al.
2003/0049046 A1 3/2003 Okabe

FOREIGN PATENT DOCUMENTS

EP 1 031 891 A1 8/2000
EP 1 054 308 A2 11/2000
JP A 10-260566 9/1998
JP A-2000-250310 9/2000
JP A-2001-5268 1/2001
JP A-2001-142376 5/2001
JP A 2002-149037 5/2002
JP A-2002-278411 9/2002
JP A 2003-84647 3/2003

* cited by examiner

*Primary Examiner*—Hoan Tran
(74) *Attorney, Agent, or Firm*—Oliff & Berridge, PLC

(57) ABSTRACT

A lever is provided in a photosensitive member frame of a photosensitive member cartridge that accommodates a developing cartridge in a cartridge accommodating portion. The lever is engaged with an engaging shaft of the developing cartridge, and is movable between a contact position and a separation position. When the lever is in the contact position, a developing roller and a photosensitive drum make contact with each other, and when the lever is in the separation position, the developing roller and the photosensitive drum are separated.

44 Claims, 11 Drawing Sheets

DEVELOPING CARTRIDGE, PHOTOSENSITIVE MEMBER CARTRIDGE, PROCESS UNIT, AND IMAGE FORMING APPARATUS

BACKGROUND OF THE INVENTION

1. Field of Invention

The invention relates to a developing cartridge, a photosensitive member cartridge, a process unit, and an image forming apparatus.

2. Description of Related Art

Conventionally, image forming apparatuses, such as laser printers, are provided with a process unit including a drum cartridge having a photosensitive drum and a toner cartridge accommodated in the drum cartridge and having a developing roller.

It is known that some process units include a separation mechanism that causes the developing roller and the photosensitive drum to make contact with each other during image developing, and keeps them separated at a warm-up.

As such a process unit, Japanese Laid-Open Patent Publication No. 2003-84647 proposes to be disposed at each side of a main body case for engagement with an engaging portion provided on each side of the developing unit, for example.

SUMMARY OF THE INVENTION

However, if the separation mechanism is provided in the main body case, when the developing roller makes contact with or is separated from the photosensitive drum, the drum cartridge is apt to move integrally with the developing unit, a distance between the developing roller and the photosensitive drum would become unstable, thereby a reliable separation can not be achieved.

The invention thus provides, among other things, a developing cartridge, a photosensitive member cartridge, a process unit where the developing cartridge is accommodated in the photosensitive member cartridge, and an image forming apparatus including the process unit, which are capable of separating a developing agent carrier from a photosensitive member with stability to secure a reliable separation.

According to one exemplary aspect, a photosensitive member cartridge is detachably attached to a main body frame of an image forming apparatus. The photosensitive member cartridge includes a photosensitive member, a frame that supports the photosensitive member, an accommodating portion that is provided in the frame and accommodates a developing cartridge including a developing agent carrier, and a lever that is provided in the frame and movable between a contact position and a separation position. The lever maintains the developing agent carrier in contact with the photosensitive member when in the contact position, and the lever maintains the developing agent carrier out of contact with the photosensitive member when in the separation position.

With such a structure, when the lever provided in the frame of the photosensitive member cartridge is in engagement with the developing cartridge, the lever moves between the contact position and the separation position, thereby the developing agent carrier and the photosensitive member are brought into contact with or separated from each other. Thus, this prevents the developing agent carrier from moving along with the photosensitive member cartridge. As a result, the developing agent carrier can be stably separated from the photosensitive member, and a reliable separation can be achieved.

According to another exemplary aspect, a process unit includes a developing cartridge that includes a developing agent carrier and an engaging portion, and a photosensitive member cartridge that accommodates the developing cartridge therein. The photosensitive member cartridge includes a photosensitive member, a frame that supports the photosensitive member, an accommodating portion that is provided in the frame and accommodates a developing cartridge including a developing agent carrier, a lever that is provided in the frame and movable between a contact position and a separation position, the lever maintains the developing agent carrier in contact with the photosensitive member when in the contact position, and maintains the developing agent carrier out of contact with the photosensitive member when in the separation position, and an urging member that urges the lever to the contact position.

With such a structure, the engaging portion of the developing cartridge engages the lever, and the lever moves between the contact position and the separation position, thereby the developing agent carrier and the photosensitive member are brought into contact with or separated from each other. This prevents the developing agent carrier from moving along with the photosensitive member cartridge. As a result, the developing agent carrier can be stably separated from the photosensitive member and a reliable separation can be achieved.

According to yet another exemplary aspect, an image forming apparatus includes a process unit; and a process unit accommodating portion that accommodates the process unit. The process unit includes a developing cartridge and a photosensitive member cartridge that accommodates the developing cartridge therein. The developing cartridge includes a developing agent carrier and an engaging portion. The photosensitive member cartridge includes a photosensitive member; a frame that supports the photosensitive member; a cartridge accommodating portion that is provided in the frame and accommodates the developing cartridge therein; and a lever that is provided in the frame and movable between a contact position and a separation position. The lever includes a receiving portion that receives the engaging portion so as to maintain the developing agent carrier in contact with the photosensitive member when in the contact position, and to maintain the developing agent carrier out of contact with the photosensitive member when in the separation position.

With such a structure, when the engaging portion of the developing cartridge is received in the receiving portion of the lever, the lever moves between the contact position and the separation position, thereby the developing agent carrier and the photosensitive member are brought into contact with or separated from each other. This prevents the developing agent carrier from moving along with the photosensitive member cartridge. As a result, the developing agent carrier can be stably separated from the photosensitive member and a reliable separation can be achieved.

According to a further exemplary aspect, there is provided a developing cartridge detachably attached to a photosensitive member cartridge. The photosensitive member cartridge has a photosensitive member; a frame that supports the photosensitive member; an accommodating portion that is provided in the frame and accommodates a developing cartridge including a developing agent carrier; and a lever that is provided in the frame and movable between a contact position and a separation position. The lever maintains the developing agent carrier in contact with the photosensitive member when in the contact position. The lever maintains the developing agent carrier out of contact with the photosensitive member when in the separation position. The developing cartridge includes an engaging portion that is engageable with the lever.

With such a structure, when the lever provided in the frame of the photosensitive member cartridge is in engagement with the developing cartridge, the lever moves between the contact position and the separation position, whereby the developing agent carrier and the photosensitive member are brought into contact with or separated from each other. This prevents the developing agent carrier from moving along with the photosensitive member cartridge. As a result, the developing agent carrier can be stably separated from the photosensitive member, whereby a reliable separation can be achieved.

However, if an accident, such as a paper jam, occurs, the separation mechanism remains engaged with the engaging portion in order to cause the developing roller and the photosensitive drum to contact each other. Thus, the process unit cannot be smoothly detached from the main body case due to the engagement between the separation mechanism and the engaging portion. If the process unit is forcibly detached from the main body case, the separation mechanism and the engaging portion may be damaged.

The invention provides, among other things, an image forming apparatus that enables contact or separation between a developing agent carrier and a photosensitive member and smooth attaching and detaching of a process unit with respect to an accommodating portion.

According to a yet further exemplary aspect, an image forming apparatus includes a process unit that is detachably attached to the image forming apparatus. The process unit includes a photosensitive member, a developing agent carrier, and a lever that is movable between a contact position at which the photosensitive member and the developing agent carrier are pressed into contact with each other and a separation position at which the photosensitive member and the developing agent carrier are separated from each other. The image forming apparatus further includes a frame that includes an accommodating portion that accommodates the process unit and an opening that communicates to the accommodating portion; a moving member that detachably engages with the lever and moves the lever between the contact position and the separation position; a cover that moves between a closed position that covers the opening and an open position that uncovers the opening; and an engagement releasing member that releases an engagement between the lever and the moving member along with a move of the cover from the closed position to the open position.

With such a structure, the lever is moved between the contact position and the separation position due to an engagement between the moving member and the lever, whereby the photosensitive member and the developing agent carrier can make contact with or separate from each other. When the cover is moved from the closed position to the open position to remove the process unit from the accommodating portion, the engagement releasing member releases the engagement between the lever and the moving member with the move of the cover. Thus, while the developing cartridge and the photosensitive member can make contact with or separate from each other, when the process unit is removed from the accommodating portion, even if the lever engages the moving member, the engagement therebetween can be released with the move of the cover from the closed position to the open position, and a smooth attaching and detaching of the process unit with respect to the accommodating portion can be achieved.

According to a further exemplary aspect of the invention, an image forming apparatus includes a main body frame. The main body frame includes a process unit detachably attached to the image forming apparatus; an accommodating portion that accommodates the process unit; an opening that communicates to the accommodating portion; and a guide portion that guides the process unit from the opening to the accommodating portion. The image forming apparatus further includes a moving member that moves between a first position at which the process unit is stopped to move in a direction toward the opening and a second position at which the process unit is allowed to move in the direction toward the opening when the process unit is inserted into the accommodating portion; a cover that moves between a closed position that covers the opening and an open position that releases the opening; and an actuator that moves the moving member from the first position to the second position along with a move of the cover from the closed position to the open position. With such a structure, when the cover is moved from the closed position to the open position, the actuator synchronously moves the moving member from the first position to the second position. Thus, the move of the process unit toward the opening can be allowed.

BRIEF DESCRIPTION OF THE DRAWINGS

An exemplary embodiment of the invention will be described in detail with reference to the following figures wherein.

DETAILED DESCRIPTION OF PREFERRED EMBODIMENTS

Figure 1:
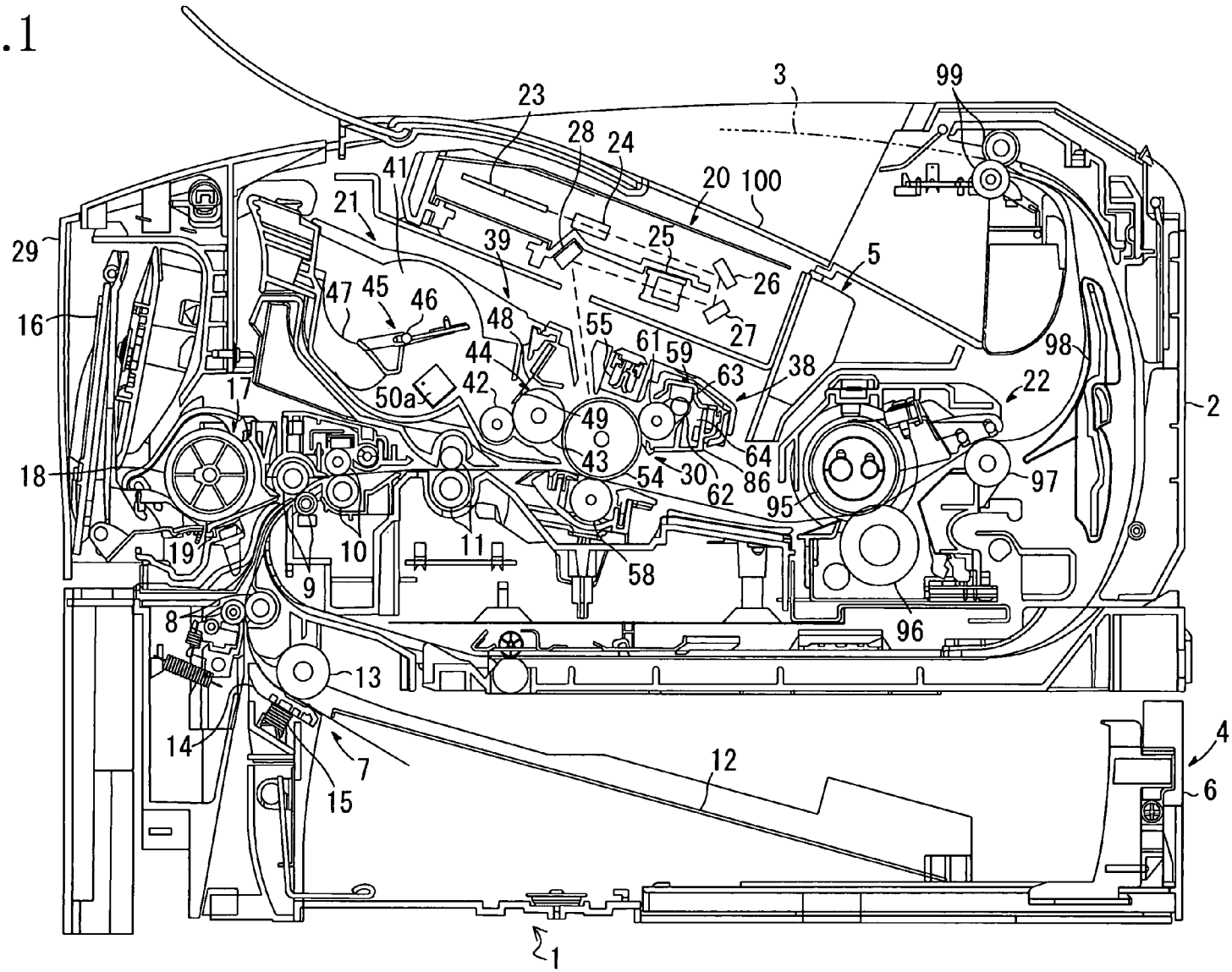
FIG. 1 is a sectional side elevation view of general structure of a laser printer.

In FIG. 1, a laser printer 1 is an electrophotographic printer for forming images by non-magnetic one-component image development. The laser printer 1 includes, in a main body frame 2, a feeder unit 4 for supplying sheets 3, and an image forming portion 5 for forming images on the sheets 3 supplied.

The feeder unit 4 includes a sheet feed tray 6, which is detachably mounted at the bottom of the main body frame 2, a sheet feed mechanism 7 provided at an end of the sheet feed tray 6 (hereinafter referred to as a front side of the printer and the other end is referred to as a rear side of the printer), conveying rollers 8, 9, 10, provided downstream from the sheet feed mechanism 7 with respect to a direction in which the sheets 3 are conveyed, and resist rollers 11 provided downstream from the conveying rollers 8, 9, 10 with respect to the direction in which the sheets 3 are conveyed.

The sheet feed tray 6 has an open-top box shape so as to hold sheets 3 in layers, and is detachably removed or attached horizontally with respect to the bottom of the main body frame 2. In the sheet feed tray 6, a paper pressing plate 12 is provided. The paper pressing plate 12 allows sheets 3 to be stacked thereon. The paper pressing plate 12 is pivotally supported at its end remote from the sheet feed mechanism 7 such that the presser pressing plate 12 is vertically movable at its end closest to sheet feed mechanism 7. A spring (not shown) is disposed under the paper pressing plate 12, and the paper pressing plate 12 is upwardly urged by the spring. Thus, as the stack of sheets 3 increases in quantity, the presser plate 7 is swung downwardly against the urging force of the spring on its end remote from the sheet feed mechanism 7.

The sheet feed mechanism 7 includes a paper feed roller 13, a separation pad 14 facing the paper feed roller 13, and a spring 15 disposed on the back of the separation pad 14. In the sheet feed mechanism 7, the separation pad 14 is pressed toward the paper feed roller 13 by the urging force of the spring 15.

When the paper pressing plate 12 is upwardly urged by the spring, the uppermost sheet 3 of the stack on the paper pressing plate 12 is pressed against the paper feed roller 13. Upon the rotation of the paper feed roller 13, the leading edge of the sheet 3 is pinched between the paper feed roller 13 and the separation pad 14, and singly separated from the stack by the cooperation of the paper feed roller 13 and the separation pad 14. The separated sheet 3 is fed toward the resist rollers 11 by the conveying rollers 8, 9, 10.

The resist rollers 11 are a pair of rollers designed to adjust skewing of sheets 3 and feed them to an image forming position, a contact portion between a photosensitive drum 54 and a transfer roller 58 described later.

The feeder unit 4 of the laser printer 1 further includes a multi-purpose tray 16 on which variously sized sheets 3 are loaded, a multi-purpose feed roller 18 that supplies sheets 3 held on the multi-purpose tray 16, and a multi-purpose separation pad 19 facing the multi-purpose feed roller 18. The multi-purpose tray 16 folds in a front cover 29 described later.

The image forming portion 5 includes a scanner unit 20, a process unit 21, and a fixing unit 22. The scanner unit 20 is provided in an upper part in the main body frame 2, and includes a laser emitting portion (not shown), a rotatable polygon mirror 23, lenses 24, 25, and reflecting mirrors 26, 27, 28.

A laser beam emitted from the laser emitting portion is modulated based on predetermined image data, and sequentially passes through or reflects from the polygon mirror 23, the lens 24, the reflecting mirrors 26, 27, the lens 25, and the reflecting mirror 28 in order as indicated by a broken line. The laser beam is directed to a surface of the photosensitive drum 54 in the process unit 21 described later.

The process unit 21 is disposed below the scanner unit 20 and detachably attached to the main body frame 2. The main body frame 2 includes a process unit accommodating portion 30 for storing the process unit 21, an opening 31 (FIG. 7) communicated to the process unit accommodating portion 30 for removing and attaching the process unit 21 from and to the main body frame 2, and the front cover 29 for covering or exposing the opening 31.

Figure 7:
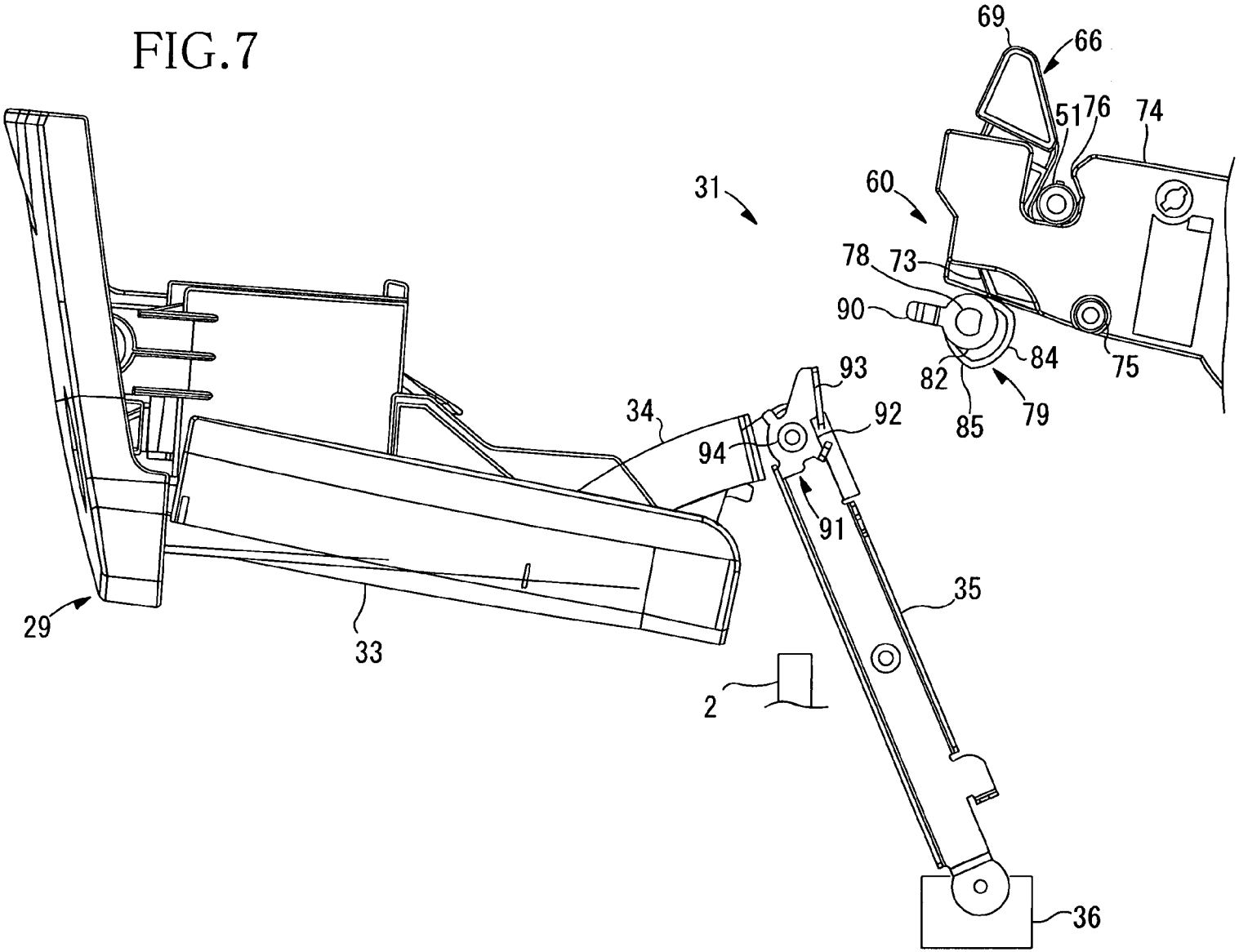
FIG. 7 is a side elevation view of essential parts near the front cover of the laser printer shown in FIG. 1 (when the front cover is open)

The process unit accommodating portion 30 is provided as a space below the scanner unit 20 in the main body frame 2. The opening 31 is formed at the front side of the process unit accommodating portion 30 (FIG. 7).

Figure 2:
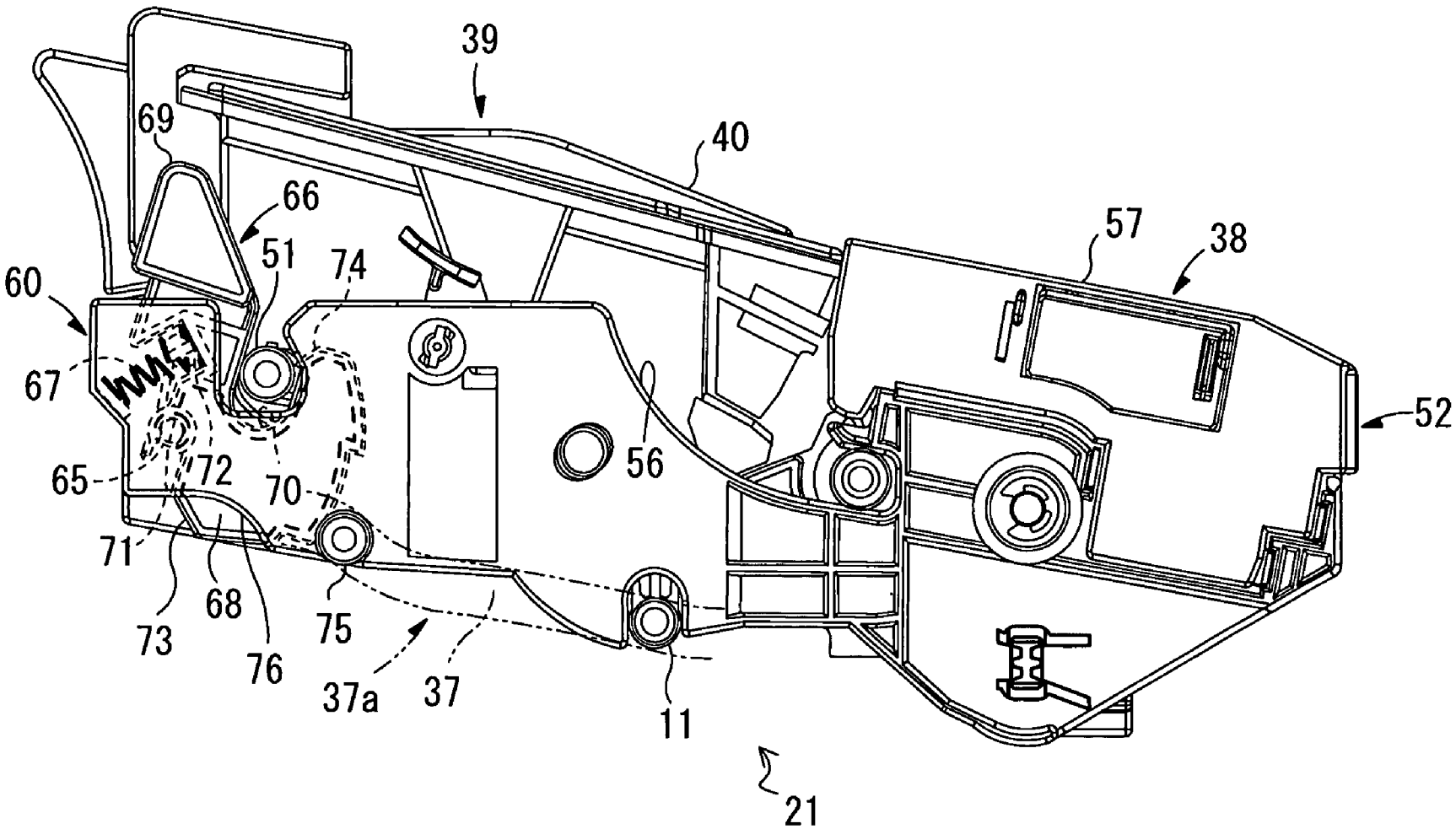
FIG. 2 is a side elevation view of a process unit of the laser printer shown in FIG. 1.

Between the opening 31 and the process unit accommodating portion 30, a guide passage 37 is provided on each side of the main body frame 2 with respect to its width direction (that is a direction perpendicular to a front-to-back direction of the main frame 2) as indicated by a phantom line of FIG. 2. In the guide passage 37, a guide groove 37*a* for guiding a guide shaft 75 described later is formed along a front-to-back direction.

Figure 6:
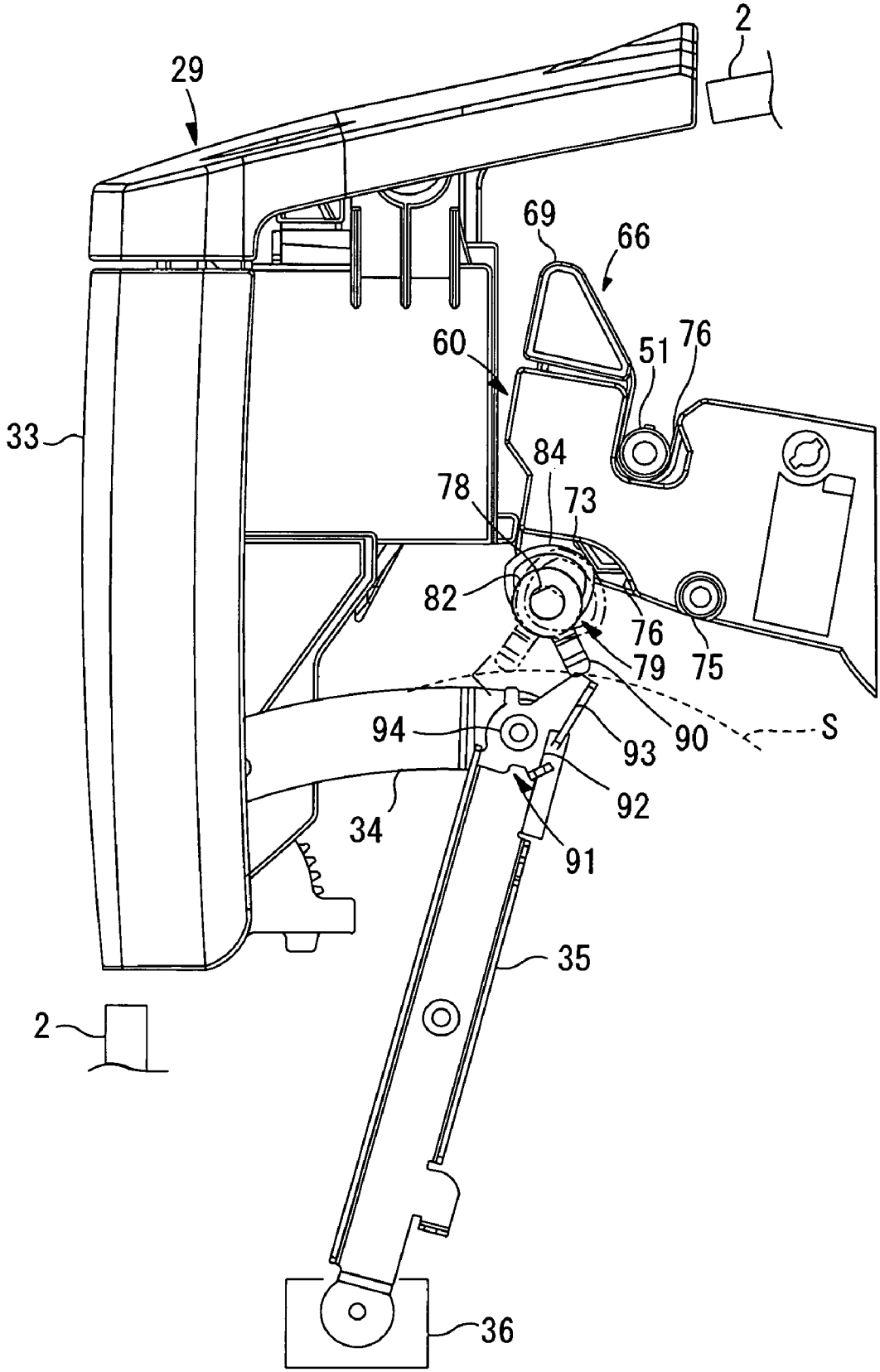
FIG. 6 is a side elevation view of essential parts near a front cover of the laser printer shown in FIG. 1 (when the front cover is closed)

The front cover 29 is provided over the front surface and the upper surface at the front side of the main body frame 2. As shown in FIG. 6, the front cover 29 includes a cover body 33, a holder member 34, and an arm member 35.

The cover body 33 is of L-shape in a side sectional view, covering the upper part of the front surface and the front part of the upper surface of the main body frame 2. The cover body 33 is formed of a resin.

The holder member 34 is formed of substantially a curved plate, and is provided at the lower end portion of the cover body 33. The holder member 34 is pivotally supported to the lower end portion of the cover body 33 at one end, and extends rearward from the cover body 33 in substantially a horizontal direction.

The arm member 35 is formed of an elongated plate and is provided in a top-to-bottom direction relative to the holder member 34. The arm member 35 is pivotally supported to a fixing portion 36 provided in the main body frame 2 at its lower end. The arm member 35 is secured to the holder member 34 at its upper end.

An engaging plate 91 is provided at the upper end portion of each arm member 35. The engaging plate 91 serves as a releasing member that makes contact with a projecting plate 90 of a release plate 82 described later. The engaging plate 91 is disposed at a rear side of a lower portion of the projecting plate 90 of the release plate 82 when the front cover 29 is in the closed position described later. An engaging body 92 and an engaging portion 93 are formed integrally. The engaging body 92 is secured via a fixing shaft 94 and the engaging portion 93 serves as a projecting portion that projects upward from the engaging body 92 tapering upward in a triangular-trapezoid shape.

The front cover 29 pivots about the lower end portion of the arm member 35 between a closed position shown in FIG. 6 and an open position shown in FIG. 7. The front cover 29 releases the opening 31 at the open position and covers it at the closed position. The process unit 21 is removed from or attached to the process unit accommodating portion 30 via the opening 31 when the front cover 29 is kept in the open position as shown in FIG. 7.

As shown in FIGS. 1 and 2, the process unit 21 is provided with a photosensitive member cartridge 38 and a developing cartridge 39. The photosensitive member cartridge 38 is removed from and attached to the main body frame 2, and the developing cartridge 39 is placed in the photosensitive member cartridge 38.

The developing cartridge 39 includes, in a developing frame 40, a toner hopper 41, a supply roller 42, a developing roller 43, and a layer thickness regulating blade 44, which are located at the rear of the toner hopper 41.

The developing cartridge 39 includes engaging shafts 51 serving as an engaging portion at the lower front portion of the developing frame 40. The engaging shafts 51 project from both ends of the developing roller 43 in a direction parallel to an axial direction of the developing roller 43, in other words, outwardly from both sides of the developing frame 40.

The toner hopper 41 contains positively charged nonmagnetic single-component toner as a developing agent. This toner is a polymerized toner obtained through copolymerization of styrene-based monomers, such as styrene, and acryl-based monomers, such as acrylic acid, alkyl (C1–C4) acrylate, or alkyl (C1–C4) methacrylate, using a known polymerization method, such as suspension polymerization. The particle shape of such a polymerized toner is spherical, its particle size is approximately 6–10 μm and thus the polymerized toner has excellent flowability. A coloring agent, such as carbon black, and wax are added to the polymerized toner. An external additive, such as silica, is also added to the polymerized toner to improve flowability.

An agitator 45 is provided in the toner hopper 41. The agitator 45 includes a rotating shaft 46 and an agitating blade 47. The rotating shaft 46 is disposed along the width direction of the developing frame 40 and rotatably supported at a central position in the toner hopper 41. The agitating blade 47 is provided around the rotating shaft 46. The rotating shaft 46 is supported at one side to the developing frame 40 such as to be inserted. The other end of the rotating shaft 46 is fixed to a shaft accommodating portion 50 (FIG. 4) provided at the other side of the developing frame 40. A film is affixed at a free end of the agitating blade 47. When the rotating shaft 46 rotates, the agitating blade 47 moves in a circumferential direction, the film scrapes toner in the toner hopper 41, and supplies the toner toward the supply roller 42.

A window 50*a* (FIG. 4) for detection of the remaining quantity of toner is provided on each side of the developing frame 40 defining the toner hopper 41 with respect to the width direction thereof.

The supply roller 42 is provided at the rear of the toner hopper 41 along the width direction of the developing frame 40, and rotatably supported at both sides of the developing frame 40. The supply roller 42 is disposed such as to rotate opposite to the rotation direction of the agitator 45. The supply roller 42 is formed by covering a metallic roller shaft with a conductive urethane sponge.

The developing roller 43 is provided at the rear of the supply roller 42 along the width direction of the developing frame 40 and rotatably supported at both ends of the developing frame 40. The developing roller 43 is disposed so as to rotate in the same direction as the rotation direction of the supply roller 42.

The developing roller 43 is formed by covering a metallic roller shaft with an electrically conductive flexible material, such as electrically conductive urethane or silicone rubber containing fine carbon particles, and with a coat layer of a urethane or silicone rubber containing fluorine. The roller shaft of the developing roller 43 is connected to a power supply (not shown), and receives a specified developing bias during developing.

The supply roller 42 and the developing roller 43 are disposed facing each other and in contact with each other so that the supply roller 42 press-deforms the developing roller 43 to an appropriate extent. The supply roller 42 and the developing roller 43 rotate in the opposite directions at the contact portion.

The layer thickness regulating blade 44 is provided along the width of the developing frame 40 above the supply roller 42 and between an opposing position of the developing roller 43 and the supply roller 42 and an opposing position of the developing roller 43 and the photosensitive drum 54 in the rotation direction of the developing roller 43. The layer thickness regulating blade 44 is disposed along the axial direction of the developing roller 43 so as to face the developing roller 43.

The layer thickness regulating blade 44 includes a plate spring member 48 and a presser portion 49. The presser portion 49 is disposed on a distal end of the plate spring member 48 and formed from an electrically insulative silicone rubber to be brought in contact with the developing roller 43. In the layer thickness regulating blade 44, the presser portion 49 is pressed against the developing roller 43 by the elastic force of the plate spring member 48, which is supported to the developing frame 40.

Toner in the toner hopper 41 is scraped with the rotation of the agitator 45 and conveyed toward the supply roller 42. The toner conveyed to the supply roller 42 is supplied to the developing roller 43 with the rotation of the supply roller 42. While the toner is supplied from the supply roller 42 to the developing roller 43, it is positively charged between the supply roller 42 and the developing roller 43 due to friction.

The charged toner is carried on the developing roller 43, and passes between the developing roller 43 and the presser portion 49 of the layer thickness regulating blade 44 by rotation of the developing roller 43. When passing between the developing roller 43 and the presser portion 49, toner is further charged due to friction, and formed into a thin layer of a predetermined thickness on the developing roller 43.

Figure 3:
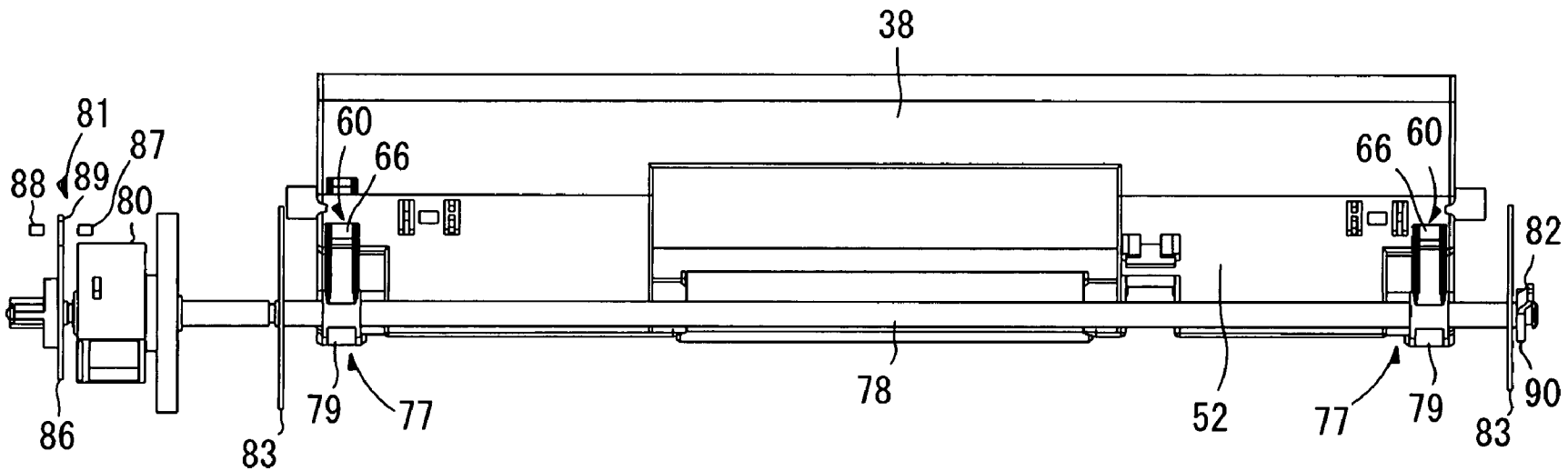
FIG. 3 is a plan view of essential parts of the process unit shown in FIG. 2.

The photosensitive member cartridge 38 includes a photosensitive member frame 52 as a frame, a photosensitive drum 54, a scorotron charger 55, the transfer roller 58, a cleaning portion 59, and cartridge-side separation mechanisms 60 (FIG. 3).

The rear portion of the photosensitive member frame 52 is formed as a box-shaped drum accommodating portion 57 for storing the photosensitive drum 54, the scorotron charger 55, the transfer roller 58 and the cleaning portion 59. The front portion of the photosensitive member frame 52 is open-topped and formed as a cartridge accommodating portion 56 for storing the developing cartridge 39.

The guide shaft 75, as a guide member, is provided at a lower edge, positioned centrally with respect to the front-to-rear direction, of each sidewall defining the cartridge accommodating portion 56 such as to protrude outwardly from the sidewall. On front lower edge of each sidewall defining the cartridge accommodating portion 56, a cut portion 76 is opened for exposing the lower end of a lever 66, described later.

As shown in FIG. 1, the photosensitive drum 54 is disposed facing the developing roller 43, behind the developing roller 43, when the developing cartridge 39 is mounted in the photosensitive member cartridge 38. The photosensitive drum 54 is provided along the width of the photosensitive member frame 52 and rotatably supported at both sides of the photosensitive member frame 52. The photosensitive drum 54 is formed by coating a cylindrical aluminum drum with a positively charged photosensitive layer made of polycarbonate. The cylindrical aluminum drum is electrically grounded.

The scorotron charger 55 is disposed above the photosensitive drum 54 so as to face the photosensitive drum 54 at a predetermined distance away, and provided along the width of the photosensitive member frame 52. The scorotron charger 55 produces a corona discharge from a tungsten wire and positively charges the surface of the photosensitive drum uniformly.

When the photosensitive drum 54 rotates, its surface is uniformly, positively charged by the scorotron charger 55. A laser beam emitted from the scanner unit 20, based on the predetermined image data, is directed to the surface of the photosensitive drum 54, and an electrostatic latent image is formed.

When the developing roller 43 rotates, positively charged toner on the developing roller 43 faces the photosensitive drum 54. When the toner makes contact with the photosensitive drum 54, the toner is supplied to the electrostatic latent image formed on the photosensitive drum 54. That is, the toner is supplied to a low-potential portion of the photosensitive drum 54 and selectively carried on the photosensitive drum 54. Thereby, the electrostatic latent image becomes visible.

The transfer roller 58 is disposed facing the photosensitive drum 54 beneath, provided along the width of the photosensitive member frame 52, and rotatably supported at both sides of the photosensitive member frame 52. The transfer roller 58 is formed by covering a metallic roller shaft with an electrically conductive rubber material, and the roller shaft is connected to a power supply (not shown). When toner is transferred to a sheet 3, a transfer bias is applied.

With rotation of the photosensitive drum 54, the sheet 3 conveyed from the resist rollers 11 passes between the photosensitive drum 54 and the transfer roller 58 while making contact with the surface of the photosensitive drum 54, toner carried on the photosensitive drum 54 is transferred to the sheet 3. The sheet 3 on which toner has been transferred is conveyed toward the fixing unit 22.

The cleaning portion 59 is disposed on a side of the photosensitive drum 54, which is opposite the developing roller 34, at a rear portion of the drum accommodating portion 57. The cleaning portion 59 includes a first cleaning roller 61, a second cleaning roller 62, a scraping sponge 63, and a paper dust reservoir 64.

The first cleaning roller 61 is disposed facing the photosensitive drum 54, provided along the width of the photosensitive member frame 52, and rotatably supported at both sides of the photosensitive member frame 52. A cleaning bias is applied to the first cleaning roller 61 during cleaning. The second cleaning roller 62 is disposed facing the first cleaning roller 61, provided along the width of the photosensitive member frame 52, and rotatably supported at both sides of the photosensitive member frame 52.

The scraping sponge 63 is disposed facing the second cleaning roller 62 so as to make contact with the second cleaning roller 62, provided along the width of the photosensitive member frame 52, and rotatably supported at both sides of the photosensitive member frame 52. The paper dust reservoir 64 is formed as a space in the drum accommodating portion 57 behind the first cleaning roller 61.

In the cleaning portion 59, when toner is transferred to the sheet 3, a low bias is applied to the first cleaning roller 61, and toner remaining on the photosensitive drum 54 is temporarily caught by the first cleaning roller 61. On the other hand, when toner is not transferred to the sheet 3, in other words, during a time interval of two sheets 3 successively conveyed, a high bias is applied to the first cleaning roller 61, the toner temporarily caught by the first cleaning roller 61 is returned to the photosensitive drum 54, and paper dust of the sheet 3 adhered to the photosensitive drum 54 during transfer is caught by the first cleaning roller 61. The toner returned to the photosensitive drum 54 is collected by the developing roller 43. The paper dust caught by the first cleaning roller 61 is caught by the second cleaning roller 62 when facing to the second cleaning roller 62. The paper dust caught by the second cleaning roller 62 is scraped by the scraping sponge 63 when facing to the scraping sponge 63, and collected in the paper dust reservoir 64.

Figure 4:
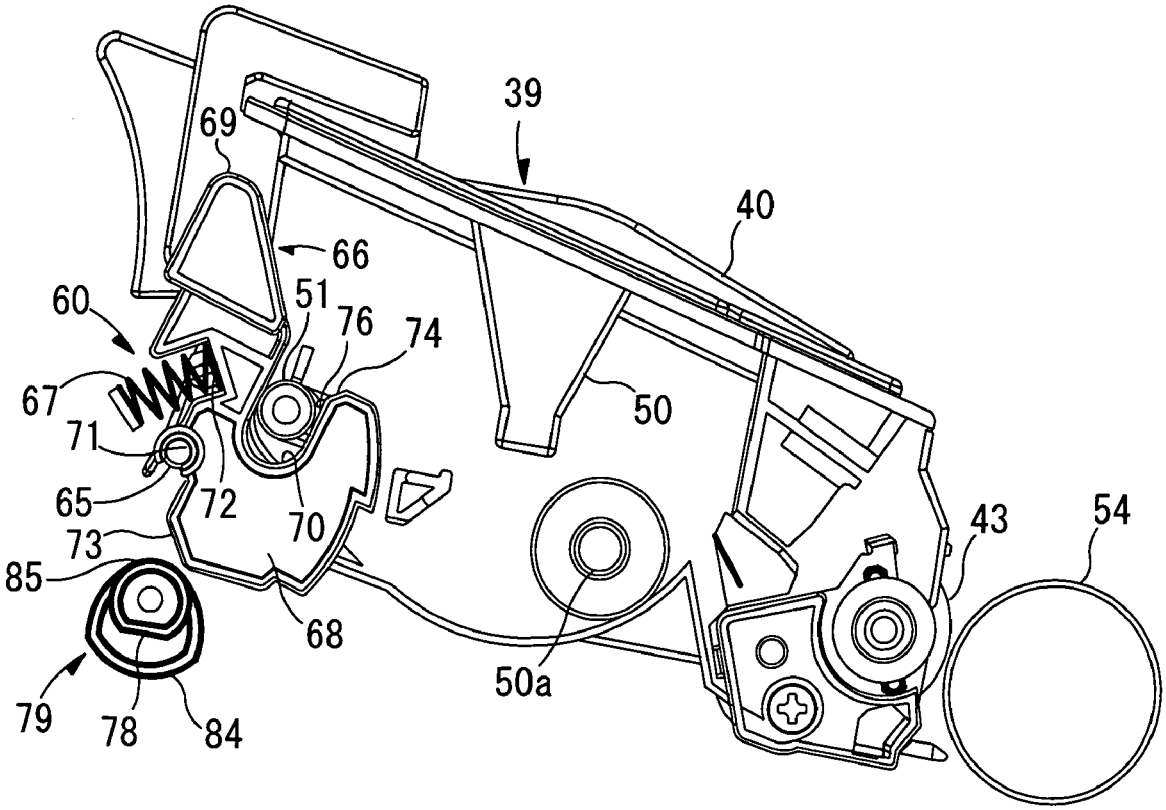
FIG. 4 is a side elevation view of a developing cartridge of the process unit shown in FIG. 2 (showing a developing roller and a photosensitive drum in contact with each other)

Each cartridge-side separation mechanism 60 includes a support shaft 65 as a supporting member, a lever 66, and a spring 67 as an urging member, as shown in FIG. 2. As shown in FIGS. 2 and 4, the support shaft 65 is provided at the front part of each sidewall defining the cartridge accommodating portion 56 such as to protrude inwardly.

The levers 66 are disposed to correspond to respective support shafts 65 on both sides of the photosensitive drum 54 with respect to its axial direction, more specifically, at a front part of both sidewalls defining the cartridge accommodating portion 56. Each lever 66 is made up of a lever body 68, a handle portion 69, a first receiving portion 70, a second receiving portion 71, a spring receiving portion 72, and an abutment surface 73, which are all integrally formed. The lever body 68 is formed of a plate. The handle portion 69 is formed at the upper part of the lever body 68 at the front side. The first receiving portion 70 is open in substantially a U-shape groove upwardly from a central portion of the upper end of the lever body 68. The second receiving portion 71 is open in substantially a U-shape groove downwardly from a lower portion of the front end of the lever body 68. The spring receiving portion 72 is formed between the handle portion 69 and the second receiving portion 71 at the front end of the lever body 68 and formed in a recess obliquely upward toward the rear. The abutment surface 73 is formed at a bevel at the lower front part of the lever body 68. An opening of the first receiving portion 70 of the lever 66 is provided with an inclined surface 74 for inducing an engaging shaft 51.

The lever 66 is pivotally supported by the support shaft 65 engaging in the downwardly opening second receiving portion 71. The lever 66 can rock between a contact position where the developing roller 43 and the photosensitive drum 54 make contact with each other and a separation position where the developing roller 43 and the photosensitive drum 54 are separated. The lower end portion of the lever 66, including the abutment surface 73, is communicated to the lower part of the cartridge accommodating portion 56 via the cut portion 76.

The spring 67 is engaged with the front wall defining the cartridge accommodating portion 56 at one end, and received at the spring receiving portion 72 at the other end, on each side of the front end part defining the cartridge accommodating portion 56 with respect to its width.

Thereby, each lever 66 is always urged by the urging force of the spring 67 such that the upper part of the lever 66 inclines rearward and the lower part thereof inclines frontward using the support shaft 65 as a fulcrum. Thus, the lever 66 is always urged by the urging force of the spring 67 to be situated in the contact position.

The main body frame 2 includes a main body-side separation mechanism 77 for rocking each lever 66, as shown in FIG. 3. The main body-side separation mechanism 77 includes a drive shaft 78 as a connecting member, cams 79 as a pressing member and a moving member, a clutch 80, a sensor portion 81 as a detector, and a release plate 82 as a contacting member.

As shown in FIGS. 3 and 4, the drive shaft 78 is rotatably supported at shaft supporting portions 83 disposed on both sides of the main body frame 2 with respect its width direction so as to face the lower part of the front part of the photosensitive member frame 52 mounted in the main body frame 2.

Figure 5:
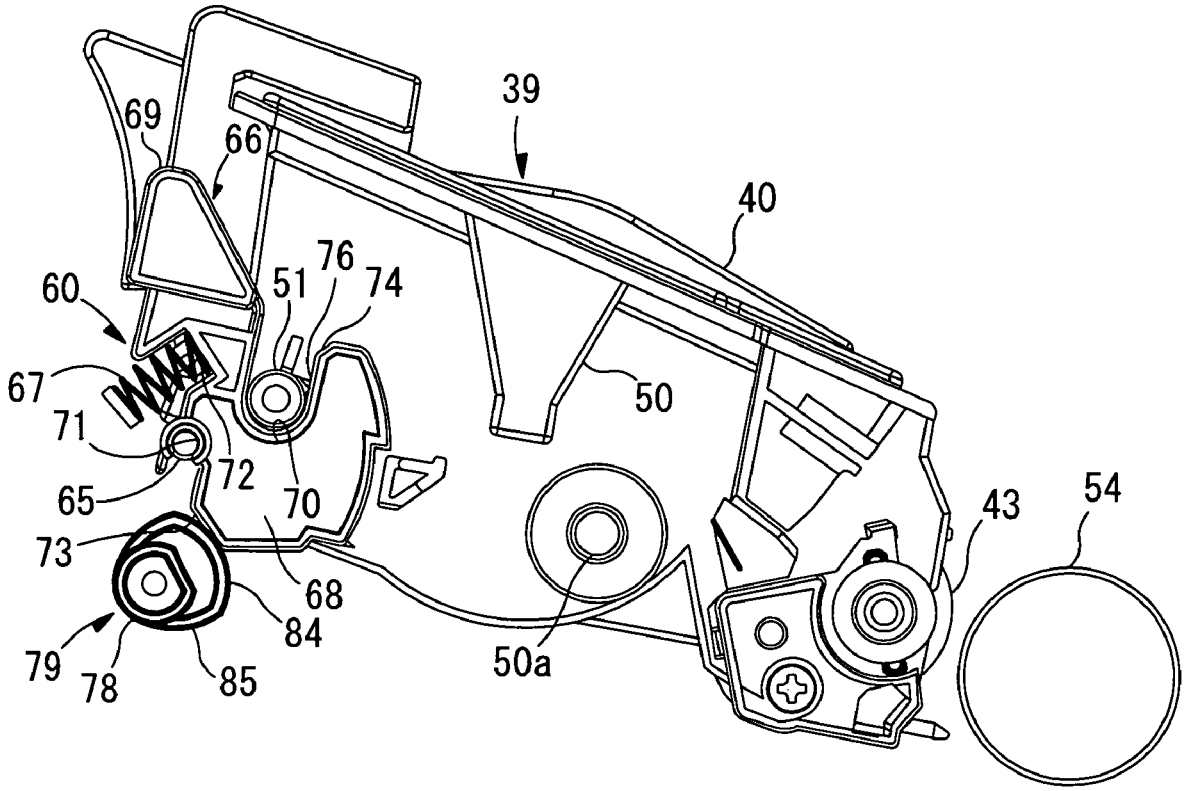
FIG. 5 is a side elevation view of the developing cartridge of the process unit shown in FIG. 2 (showing the developing roller and the photosensitive drum spaced apart from each other)

The cams 79 are disposed on the drive shaft 78 such as to face each lever 66 of the photosensitive member frame 52 mounted in the main body frame 2. Each cam 79 is made of a thick plate, which is eccentric to the drive shaft 78, and includes a first cam surface 84, which makes contact with the abutment surface 73 of the lever 66, as shown in FIG. 5, and a second cam surface 85, which does not make contact with the abutment surface 73 of the lever 66, as shown in FIG. 4.

Each cam 79 is provided such that it is located on the same phase with respective to each lever 66, that is, such that the first cam surface 84 and the second cam surface 85 are located at the same position with respect to each lever 66 in a side elevation view. Each cam 79 cannot be rotated relative to the drive shaft 78. Thus, each cam 79 is rotated integrally with the drive shaft 78 such that the first cam surface 84 and the second cam surface 85 alternately face the abutment surface 73 of each lever 66 with the same timing. In other words, each cam 79 is rotated in such a manner that the first cam surface 84 and the second surface 85 are alternately and repeatedly engaged with and separated from the abutment surface 73 of the corresponding lever 66 between a pressing position (a first position) where the first cam surface 84 of the cam 79 faces and makes contact with the abutment surface 73 of the lever 66 and a non-pressing position (a second position) where the second cam surface 85 of the cam 79 faces the abutment surface 73 of the lever 66.

The clutch 80 is disposed on one end of the drive shaft 78 with respect to its axial direction and outside from the shaft supporting portion 83. Power from a main motor 113 (FIG. 11) as a drive unit (drive portion) is inputted to the clutch 80, and the clutch 80 transmits or interrupts the power to the drive shaft 78. The clutch 80 is comprised of a known spring clutch, and transmits the power from the main motor 113 (FIG. 11) to the drive shaft 78 via a gear train (not shown) in the on state. The clutch 80 interrupts transmission of the power from the main motor 113 (FIG. 11) to the drive shaft 78 in the off state.

When the clutch 80 is in the on state, power from the main motor 113 (FIG. 11) is transmitted to the drive shaft 78, and the cams 79 rotate. On the other hand, when the clutch 80 is in the off state, for example, at the completion of printing or in the event of an error, transmission of the power from the main motor 113 (FIG. 11) to the drive shaft 78 is interrupted, and the cams 79 become freely rotatable.

The sensor portion 81 includes a sensor disk 86 as a light-shielding plate, a light emitting portion 87, and a light-receiving portion 88. The sensor disk 86 is disposed on one end of the drive shaft 78 with respect to its axial direction and outside from the clutch 80. The sensor disk 86 is a substantially circular plate, and is formed integrally with a light-shielding portion 89 substantially in a fan-like form, as shown in FIG. 8B.

The light emitting portion 87 and the light receiving portion 88 are structured as a light sensor, and disposed facing each other over the interrupting portion 89 of the sensor disk 86. Thereby, the interrupting portion 89 of the sensor disk 86 passes between the light emitting portion 87 and the light receiving portion 88 with rotation of the drive shaft 78.

Figure 8A:
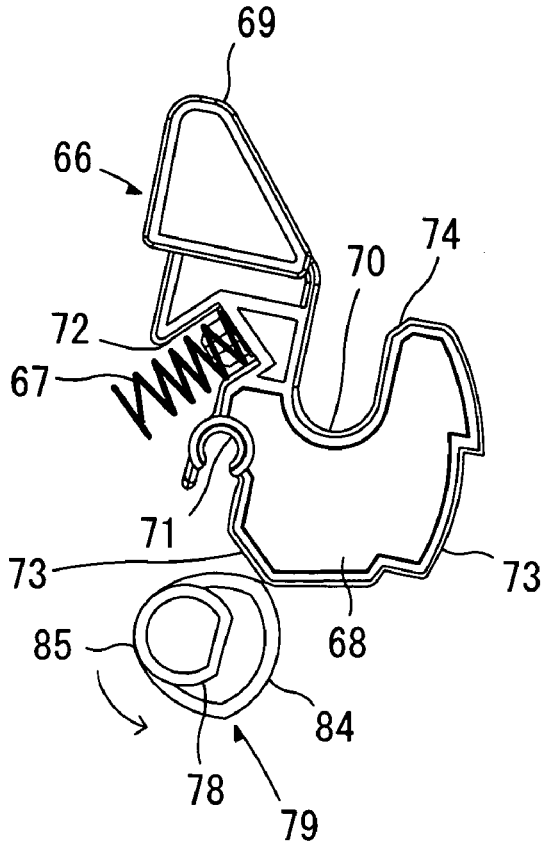
FIG. 8A is a side elevation view of essential parts showing a relationship between a lever and a cam (at a start of contact)
Figure 8B:
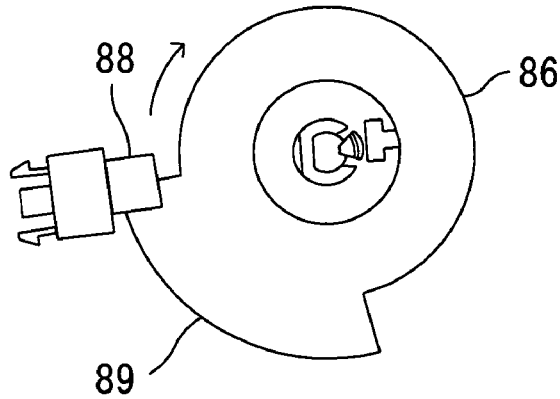
FIG. 8B is a side elevation view of essential parts showing a sensor portion (at a start of interruption of light by a light interrupting portion)
Figure 9A:
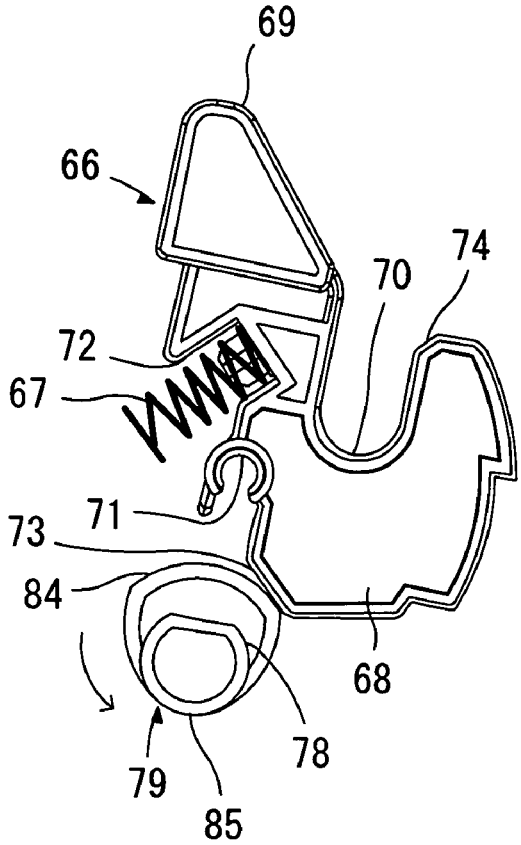
FIG. 9A is a side elevation view of essential parts showing the relationship between the lever and the cam (at a finish of contact)
Figure 9B:
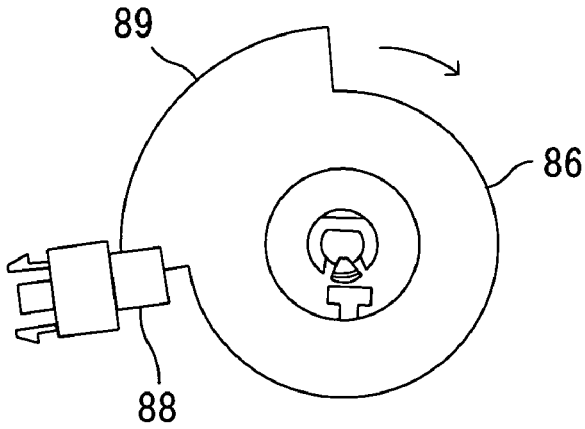
FIG. 9B is a side sectional view of essential parts showing the sensor portion (at a finish of interruption of light by the light interrupting portion)

As shown in FIG. 8A, the first cam surface 84 of the cam 79 starts to make contact with the abutment surface 73 of the lever 66 with the rotation of the drive shaft 78. In synchronization with this, in the sensor portion 81, as shown in FIG. 8B, the interrupting portion 89 starts to enter between the light emitting portion 87 and the light receiving portion 88, and light going from the light emitting portion 87 to the light receiving portion 88 is interrupted. In addition, as shown in FIG. 9A, the first cam surface 84 of the cam 79 finishes to make contact with the abutment surface 73 of the lever 66 with the rotation of the drive shaft 78. In synchronization with this, as shown in FIG. 9B, the interrupting portion 89 finishes passing between the light emitting portion 87 and the light receiving portion 88, and the light going from the light emitting portion 87 to the light receiving portion 88 is then allowed to pass. In other words, in the sensor portion 81, the light going from the light emitting portion 87 to the light receiving portion 88 is interrupted while the cam 79 presses the lever 66, and is allowed to pass while the cam 79 does not press the lever 66. Thereby, the sensor portion 81 detects that the cam 79 is in the pressing position where it presses the lever 66 or in the non-pressing position where it does not press the lever 66. Therefore, it can be detected as to whether the developing roller 43 and the photosensitive drum 54 are in contact with or separated from each other.

The sensor portion 81 detects the pressing position and the non-pressing position of the cam 79 according to whether light emitted from the light emitting portion 87 and received at the light receiving portion 88 is interrupted by the light-shielding portion 89. Thus, the sensor portion 81 can detect the position of the cam 79 reliably.

The release plate 82 is disposed on the other end of the drive shaft 78 and outside from the shaft supporting member 83. The release plate 82 is a substantially circular plate, and is formed integrally with a projecting plate 90 as a projecting portion that projects substantially in a U shape form outwardly in a radial direction, as shown in FIGS. 6 and 7.

As the release plate 82 is supported on the drive shaft 78 commonly used with each cam 79, when the drive shaft 78 rotates, the release plate 82 is rotated along with each cam 79. When the cam 79 is in the pressing position where it makes contact with the abutment surface 73 of the lever 66, the projecting plate 90 is disposed such as to project obliquely downward to the rear, as indicated by a solid line of FIG. 6. When the cam 79 is in the non-pressing position where it does not make contact with the abutment surface 73 of the lever 66, the projecting plate 90 is disposed such as to project obliquely frontward, as indicated by a dot line of FIG. 6.

Thereby, when the cam 79 is in the non-pressing position, the projecting plate 90 is disposed outside a range of a path S of the engaging part 93 of the engaging plate 91 provided on the arm member 35, and does not make contact with the engaging part 93. When the cam 79 is in the pressing position, the projecting plate 90 is disposed within the path S of the engaging part 93 and makes contact with the engaging part 93.

As shown in FIG. 2, the developing cartridge 39 is accommodated in the cartridge accommodating portion 56 of the photosensitive member cartridge 38 in such a manner as to allow each engaging shaft 51 to be received in the corresponding first receiving portion, which is open upwardly, from the top. At this time, each engaging shaft 51 can be easily engaged in the first receiving portion 70 as it is guided via the inclined surface 74.

As the first receiving portion 70 is open upwardly, the engaging shaft 51 can be engaged in or released from the first receiving portion 70 in an up and down direction. Thus, engagement and disengagement between the engaging shaft 51 and the first receiving portion 70 can be simplified.

While the developing cartridge 39 is accommodated in the cartridge accommodating portion 56 of the photosensitive member cartridge 38, the lever 66 is pressed rearward at its upper part using the support shaft 65 as a fulcrum by the urging force of the spring 67, and kept in the contact position, so that the engaging shaft 51 that is engaged with the lever 66 is disposed rearward. As a result, as shown in FIG. 4, the developing cartridge 39 is disposed rearward with respect to the photosensitive member cartridge 38, and the developing roller 43 and the photosensitive drum 54 make contact with each other.

With the front cover 29 kept in the open position shown in FIG. 7, the photosensitive member cartridge 38 storing the developing cartridge 39, or the process unit 21, is mounted in the process accommodating portion 30 via the opening 31 as described above.

In this mounting, when the process unit 21 is inserted from the opening 31 into the process unit accommodating portion 30, the guide shaft 75 of the photosensitive member cartridge 38 is engaged in the guide groove 37*a* and guided through the guide groove 37*a* as shown in FIG. 2, so that the process unit 21 is mounted in the process unit accommodating portion 30.

In the process unit 21 mounted in the process unit accommodating portion 30 in this manner, during developing, in other words, during image formation, the cam 79 is withdrawn from the guide passage 37 and the first cam surface 85 of the cam 79 is disposed facing the abutment surface 73 of the lever 66 in the non-pressing position as shown in FIG. 4. When the cam 79 is in the non-pressing position, the lever 66 is placed in the contact position by the urging force of the spring 67, so that the developing roller 43 and the photosensitive drum 54 make contact with each other.

On the other hand, when there is a need to separate the developing roller 43 and the photosensitive drum 54 from each other, for example, at a warm-up time, in the laser printer 1, power from the main motor 113 (FIG. 11) is transmitted to the drive shaft 78 via the gear train (not shown) and the clutch 80, the drive shaft 78 is rotated, the cam 79 protrudes toward the guide passage 37 and then moves to the pressing position where the first cam surface 84 of the cam 79 faces and makes contact with the abutment surface 73 of the lever 66. Then, as shown in FIG. 5, as the first cam surface 84 of the cam 79 presses the abutment surface 73 of the lever 66, the lever 66 is rocked at its upper part to the front and at its lower part to the rear against the urging force of the spring 67 using the support shaft 65 as a fulcrum, and placed in the separation position. When the lever 66 is placed in the separation position, the engaging shaft 51 engaged in the first receiving portion 70 of the lever 66 is moved toward the front along with the rocking motion of the lever 66, and the developing cartridge 39 is moved toward the front with respect to the photosensitive member cartridge 38, so that the developing roller 34 is separated from the photosensitive drum 54.

Figure 10:
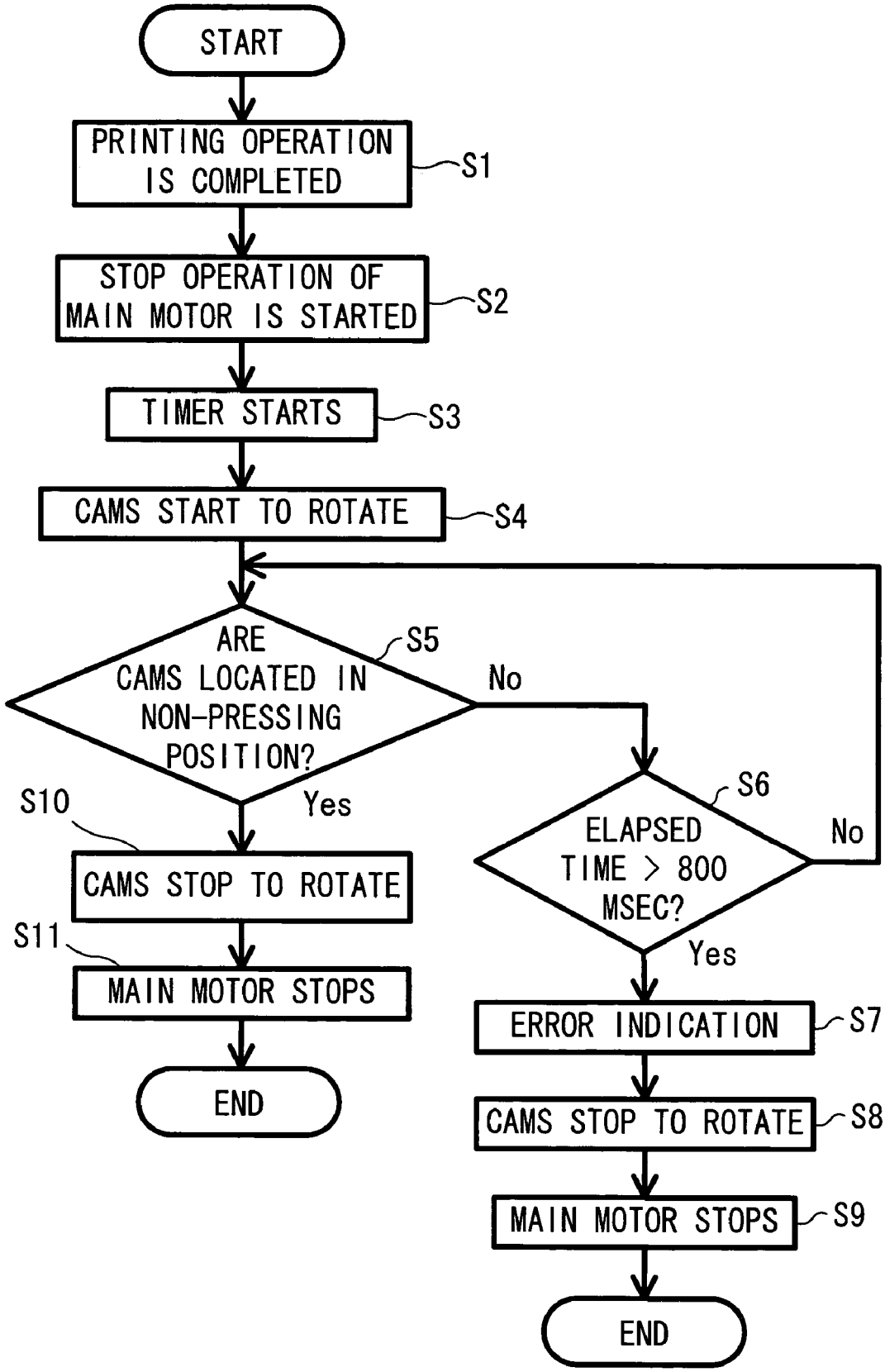
FIG. 10 is a flowchart showing a control for stopping a motor when the cam is positioned at the non-pressing position.
Figure 11:
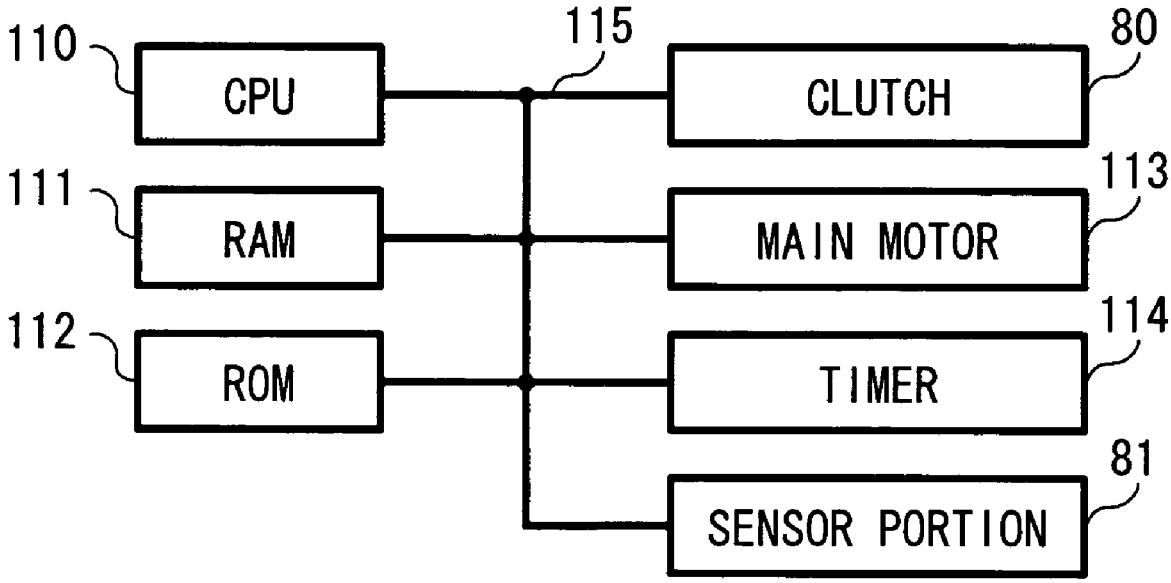
FIG. 11 is a block diagram showing a structure for performing the control shown in FIG. 10.

When normal printing operation finishes or an error occurs, it is preferable to check that the cam 79 is positioned in the non-pressing position and withdrawn from the guide passage 37 before stopping the main motor 113 (FIG. 11). When normal printing operation finishes or an error occurs, the main motor 113 (FIG. 11) is brought to a stop. However, if the main motor 113 (FIG. 11) is stopped carelessly, it may be stopped with the cam 79 remaining in the pressing position so that it presses the lever 66. In such a condition, the cam 79 protrudes toward and into the guide passage 37 thereby hindering removal of the process unit 21 from the process unit accommodating portion 30. Thus, a control shown in FIG. 10 is executed.

FIG. 11 is a block diagram of an exemplary structure for performing the control shown in FIG. 10. In FIG. 11, a RAM 111, a ROM 112, the clutch 80, the main motor 113, a timer 114 as a timekeeping device, and the sensor portion 81 are connected to a CPU 110 as a determining device and a stopping device via bus 115.

The CPU 110 controls each part of the laser printer 1. Information, such as temporary numerical values for various control actions, is stored in the RAM 111. Programs for executing the control described below and other control actions are stored in the ROM 112. The main motor 113 drives each part of the laser printer 1. The timer 114 counts a time in each control action.

The control is executed by the CPU 110 provided in the laser printer 1 as shown in FIG. 10. In this control, when printing operation is completed in S1 (S represents a single step), a stop operation of the main motor 13 is started (S2). The stop operation for stopping the main motor 113 is performed for various situations, for example, at the end of normal printing operation and in the event of an error, such as a paper jam.

When the stop operation of the main motor 113 is started, the timer 114 starts (S3) and the cams 79 are rotated (S4). The cams 79 are rotated by transmitting power from the main motor 113 to the drive shaft 78 via the gear train while engaging the clutch 80. In the control, a determination is made whether the cams 79 are located in the non-pressing positions where they are away from the corresponding levers 66 (S5). In the sensor portion 81, as described above, a light emitted from the light emitting portion 87 toward the light receiving portion 88 is interrupted by the light-shielding portion 89 when the cams 79 press the corresponding levers 66, while the light reaches the light receiving portion 88 when the cams 79 do not press the corresponding levers 66. Thus, the determination is made that the cams 79 are located in the non-pressing positions by detecting that the light reaches the light receiving portion 88.

When it is determined that the cams 79 are not located in the non-pressing positions where they are away from the corresponding levers 66 (S5: No), the determination as to whether the cams 79 are in the non-pressing positions is continuously made until the elapsed time from the start measured by the timer 114 is 800 milliseconds (msec) (S5: No, S6: No). 800 msec is a time required for the sensor disk 86 to spin around 360 degrees.

When it is not determined that the cams 79 are in the non-pressing positions where they are away from the corresponding levers 66 even if 800 msec is measured (S6: Yes), it is determined as an error caused by a problem, such as a malfunction in the sensor portion 81 or a failure of rotation of the cams 79. The error is displayed on a liquid crystal display provided on an operation panel (not shown)

(S7), the clutch 80 is disengaged to stop the rotation of the cams (S8) although the phase of the cams 79 remains unknown, the main motor 113 is stopped (S9), and the control ends.

Even when the main motor 113 is stopped with the phase of the cams 79 unknown, the cams 79 can rotate freely because the clutch 80 is disengaged. Thus, when the front cover 29 is rocked from the closed position to the open position, the cams 79 can be rotated from the pressing positions to the non-pressing positions as described above, so that the process unit 21 can be mounted in or removed from the process unit accommodating portion 30.

On the other hand, when it is determined that the cams 79 are located in the non-pressing positions until 800 msec is measured (S5: Yes), the clutch 80 is disengaged to stop the rotation of the cams 79 (S10), the main motor 113 is stopped (S11), and the control ends.

By this control, the main motor 113 can be reliably stopped in the situation that the cams 79 are located in the non-pressing positions where they are withdrawn from the guide passage 37. Thus, the main motor 113 can be stopped with the cam 79 located in the non-pressing position.

In this control, when it is not determined that the cams 79 are located in the non-pressing positions where they are away from the corresponding levers 66 even if the time exceeds 800 msec, which is a time required for the sensor disk 86 to spin around 360 degrees, it is determined as an error caused by a problem, such as a malfunction of the sensor portion 81 or a failure of rotation of the cams 79, the error is displayed on the liquid crystal display provided on the operation panel (not shown), the clutch 80 is disengaged to stop the rotation of the cams 79, and the main motor 113 is stopped. Thus, malfunction and damage to the apparatus can be prevented.

Further, in this control, the CPU 110 causes the clutch 80 to be disengaged, the cams 79 to be stopped, and the main motor 113 to be stopped. Thereby, supply of a drive force to the cams 79 can be stopped simply and reliably.

The fixing unit 22 is disposed at the rear of the process unit 21 and at a downstream side with respect to the sheet feed direction, and includes a heat roller 95, a pressure roller 96, and a conveying roller 97. The heat roller 95 includes a halogen lamp in a metallic tube as a heater. The pressure roller 96 is disposed facing the heat roller 95 beneath such as to press the heat roller 96 from below. The conveying roller 97 is disposed downstream from the heat roller 95 and the pressure roller 96 with respect to the sheet feed direction.

Toner transferred onto a sheet 3 melts due to the applied heat and is fixed on the sheet 3 while the sheet 3 passes between the heat roller 95 and the pressure roller 96. The sheet 3 is guided by the conveying roller 97 toward a guide plate 98, which is disposed vertically at the rear of the conveying roller 97, and conveyed toward ejection rollers 99. The conveyed sheet 3 is ejected by the ejection rollers 99 onto a discharge tray 100.

In the laser printer 1, the developing roller 43 is brought into contact with or separated from the photosensitive drum 54 with the cooperation of the cartridge-side separation mechanisms 60 and the main body-side separation mechanism 77 as described above. At separation, each cam 79 is moved in the pressing position as shown in FIG. 5, protrudes toward and into the guide passage 37 and presses the corresponding lever 66 from below. At this time, the engagement between the abutment surface 73 of each lever 66 and the first cam surface 84 of the corresponding cam 79 does not allow the process unit 21 to be removed from the main body frame 2 smoothly. In addition, if the process unit 21 is forcibly dragged from the main body frame 2, the levers 66 and the cams 79 will be damaged.

For this reason, the laser printer 1 is provided with the release plate 82 and the engaging plate 91 as an engagement releasing member (an actuator), in order to release the engagement between the abutment surface 73 of each lever 66 and the first cam surface 84 of the corresponding cam 79 in synchronization with the movement of the front cover 29 from the closed position to the open position.

That is, in the laser printer 1, when the developing roller 43 is separated from the photosensitive drum 54, for example, at a warm-up time, if there is a need to remove the process unit 21 from the main body frame 2 due to a paper jam, the front cover 29 is first rocked from the closed position to the open position. As the engaging part 93 of the engaging plate 91, provided at the upper end of the arm member 35, is rocked forward along with the rocking movement of the front cover 29, the engaging plate 91 presses the projecting plate 90 of the release plate 82 frontward, as shown in FIG. 6. Then, the drive shaft 78, which is in a free situation where the clutch 80 is disengaged, is rotated as shown in FIG. 7, so that the cam 79 is rotated from the pressing position to the non-pressing position, and the engagement between the abutment surface 73 of the lever 66 and the first cam surface 84 of the corresponding cam 79 is released. Thereby, each cam 79 is withdrawn from the guide passage 37, which allows the process unit 21 to move toward the opening 31.

In the laser printer 1, when the lever 66, supported to the photosensitive member frame 52 of the photosensitive member cartridge 38 via the support shaft 65, is in engagement with the engaging shaft 51 of the developing cartridge 39, the lever 66 pivots on the support shaft 65 between the contact position and the separation position, whereby the developing roller 43 and the photosensitive drum 54 are brought into contact with or separated from each other. Thus, this prevents the developing cartridge 39 from moving along with the photosensitive member cartridge 38. As a result, the developing roller 43 can be stably separated from the photosensitive drum 54, thereby securing the reliable separation operation. As the lever 66 is urged by the spring 67 such that it is located in the contact position, the developing roller 43 and the photosensitive drum 54 are brought into contact in the normal condition by a reliable urging due to a simple structure.

The developing cartridge 39 and the lever 66 are engaged by receiving the engaging shaft 51 of the developing cartridge 39 in the first receiving portion 70. Thus, a reliable engagement of the lever 66 with the developing cartridge 39 can be achieved, and a reliable contact or release between the developing roller 43 and the photosensitive drum 54 can be also achieved based on movement of the lever 66 between the contact position and the separation position.

Each lever 66 is engaged with the corresponding engaging shaft 51 on each side of the photosensitive member frame 52 with respect to its width direction. Thus, a further reliable engagement of the lever 66 with the developing cartridge 39 can be achieved.

As the inclined surface 74 for inducing the engaging shaft 51 is formed at the opening of the first receiving portion 70, the engaging shaft 51 can be guided in the first receiving portion 70 via the inclined surface 74. Thus, the engaging shaft 51 can be easily engaged in the first receiving portion 70.

As the first receiving portion 70 is open in an upward direction, the engaging shaft 51 can be engaged with or disengaged from the first receiving portion 70 in a vertical direction. Thus, the engagement and disengagement of the lever 66 with respect to the support shaft 65 can be simplified.

The lever 66 is pivotally supported to the photosensitive member frame 52 by receiving the support shaft 65 of the photosensitive member frame 52 in the second receiving portion 71. With this simple structure, the lever 66 can be provided such as to move between the contact position and the separation position.

As the second receiving portion 71 of the lever 66 is open in a downward direction, it can be engaged or disengaged with respect to the support shaft 65 in a vertical direction. Thus, engagement of the lever 66 with the support shaft 65 can be simplified.

In the laser printer 1, the process unit 21 is mounted in the process unit accommodating portion 30 of the main body frame 2 as the guide shaft 75 is guided. Thus, attachment of the process unit 21 to the main body frame 2 can be simplified.

In the laser printer 1, the lever 66 can be located in the separation position against the urging force of the spring 67 by the cam 79. Thus, the developing roller 43 and the photosensitive drum 54, which normally make contact with each other, can be separated at an appropriate timing by the cam 79.

In other words, when the cam 79 is rotated into the pressing position in the laser printer 1, the abutment surface 73 of the lever 66 is pressed by the first cam surface 84 of the cam 79, and the lever 66 is pivoted to the separation position against the urging force of the spring 67. When the cam 79 is rotated into the non-pressing position, the abutment surface 73 of the lever 66 faces the second cam surface 85 of the cam 79 without contact, the pressing by the cam 79 is released, and the cam 79 is pivoted to the contact position by the urging force of the spring 67. Thus, the lever 66 can be rocked between the separation position and the contact position in a constant period by the rotation of the cam 79 from the pressing position to the non-pressing position.

The cams 79 are provided in correspondence with each lever 66, and connected to the drive shaft 78 with the same phase, so that they can be rotated with the same phase.

The process unit 21 is inserted along a front-to-back direction with respect to the process unit accommodating portion 30. The operating point (contact point) of the first cam surface 84 of the cam 79 with the abutment surface 73 of the lever 66 is located toward the front from the engaging shaft 51 received in the first receiving portion 70 with respect to the insertion direction. Thus, when the cam 79 acts on the lever 66, the lever 66 pivots on the support shaft 65 by the pressing force acting toward the rear in the insertion direction. This enables the developing cartridge 39 to be reliably separated from the photosensitive member cartridge 38.

In the laser printer 1, if the cam 79 is in the pressing position when the process unit 21 is removed from the process unit accommodating portion 30, the front cover 29 is moved from the closed position to the open position, the arm member 35 is pivoted along with the movement of the front cover 29, the engaging part 93 of the engaging plate 91, which is provided on the upper end of the arm member 35, makes contact with the projecting plate 90 of the release plate 82 and presses the projecting plate 90 to the front. Then, the cam 79 is rotated from the pressing position to the non-pressing position, thereby engagement between the abutment surface 73 of the lever 66 and the first cam surface 84 of the cam 79 is released. Thus, even if the lever 66 and the cam 79 are engaged when the process unit 21 is removed from the process unit accommodating portion 30, the cam 79 can be rotated from the pressing position to the non-pressing position in synchronization with the movement of the front cover 29 from the open position to the closed position, to release the engagement. Thus, the process unit 21 can be smoothly attached to or removed from the process unit accommodating portion 30.

In the laser printer 1, when the process unit 21 is removed from the process unit accommodating portion 30, the clutch 80 interrupts the power transmitted from the main motor 113 to the drive shaft 78, the projecting plate 90 of the release plate 82 makes contact with the engaging part 93 of the engaging plate 91, thereby rotating the drive shaft 78, which is in the free situation. Thus, the cams 79 can be reliably rotated from the pressing position to the non-pressing position.

The release plate 82 is formed with the projecting plate 90, and the engaging plate 91 is formed with the engaging part 93. Thus, the projecting plate 90 of the release plate 82 and the engaging part 93 of the engaging plate 91 can make contact with each other reliably.

In the above description, each of the levers 66 is formed with the second receiving portion 71 opening downwardly, and the support shafts 65 are formed at both sidewalls defining the front of the cartridge accommodating portion 65 such as to face each other inwardly with respect to its width direction. Thereby, the second receiving portion 71 of each lever 66 is fitted over or removed from its respective support shaft 65 in a vertical direction. However, contrary to this, each lever 66 may be formed with a support shaft that protrudes outwardly with respect to the width direction, and a receiving portion that is open upwardly to receive the support shaft may be formed at both sidewalls defining the front of the cartridge accommodating portion 65, such that the support shaft of each lever 66 may be received at the receiving portion in a vertical direction.

Thus, in summary, in the exemplary embodiment as described, according to one exemplary aspect, a photosensitive member cartridge is detachably attached to a main body frame of an image forming apparatus. The photosensitive member cartridge includes a photosensitive member, a frame that supports the photosensitive member, an accommodating portion that is provided in the frame and accommodates a developing cartridge including a developing agent carrier, and a lever that is provided in the frame and movable between a contact position and a separation position. The lever maintains the developing agent carrier in contact with the photosensitive member when in the contact position, and the lever maintains the developing agent carrier out of contact with the photosensitive member when in the separation position.

With such a structure, when the lever provided in the frame of the photosensitive member cartridge is in engagement with the developing cartridge, the lever moves between the contact position and the separation position, thereby the developing agent carrier and the photosensitive member are brought into contact with or separated from each other. Thus, this prevents the developing agent carrier from moving along with the photosensitive member cartridge. As a result, the developing agent carrier can be stably separated from the photosensitive member, and a reliable separation can be achieved.

The photosensitive member cartridge may further include an urging member that urges the lever to the contact position. With such a structure, as the lever is urged to the contact position by the urging member, the developing agent carrier and the photosensitive member can be brought in contact with each other in a normal condition.

The urging member may be a spring. When the urging member is a spring, a reliable urging can be achieved with simple structure.

The lever may include a first receiving portion that receives an engaging portion provided in the developing cartridge, and the first receiving portion is formed in a groove that is open at one end with respect to a direction where the engaging portion is received. With such a structure, the engaging portion of the developing cartridge is received in the first receiving portion formed in a groove, so that the developing cartridge is engaged with the lever. Thus, a reliable engagement of the lever with respect to the developing cartridge can be achieved, and the developing cartridge and the photosensitive member can be reliably brought into contact with or separated from each other based on the movement of the lever between the contact position and the separation position.

The engaging portion of the developing cartridge may protrude from each of the sides of the developing agent carrier with respect to a longitudinal direction thereof in a direction parallel to the longitudinal direction, and the lever may be provided on each of the sides of the photosensitive member in the frame so as to engage with the respective engaging portion. With such a structure, as the levers are engaged with the corresponding engaging portions at each side of the developing agent carrier with respect to the longitudinal direction thereof, a further reliable engagement of the lever with respect to the developing cartridge can be achieved.

The first receiving portion may have substantially a U-shape, and may be formed with an inclined surface for guiding the engaging portion at an opening thereof. With such a structure, the engaging portion can be guided via the inclined surface in the first receiving portion formed in substantially a U-shape. Thus, the engaging portion can be simply engaged in the first receiving portion.

Further, the first receiving portion may be open upwardly. With such, the engaging portion can be attached to or removed from the first receiving portion in an up and down direction. Thus, the engagement and disengagement of the engaging portion with respect to the first receiving portion can be simplified.

The frame may include a supporting member that supports the lever pivotally. In such a structure, the lever can be pivotally supported by the supporting member.

The lever may include a second receiving portion that receives the supporting member, and the second receiving portion may be formed in a groove that is open at one end with respect to a direction where the supporting member is received. As such, the lever receives the supporting member of the frame in the second receiving portion, so that it is pivotally supported to the frame. Thus, with the simple structure, the lever can be provided to be movable between the contact position and the separation position.

The second receiving portion may be open downwardly. With such a structure, the second receiving portion can be attached to and removed from the supporting member in an up and down direction. Thus, the engagement and disengagement of the lever with respect to the supporting member can be simplified.

The frame may include a guide member that is guided to the main body frame of the image forming apparatus when the photosensitive member cartridge is attached thereto. With such a structure, the photosensitive member cartridge is mounted to the main body frame of the image forming apparatus as the guide member is guided thereto. Thus, mounting of the photosensitive member cartridge to the main body frame of the image forming apparatus can be simplified.

According to another exemplary aspect, a process unit includes a developing cartridge that includes a developing agent carrier and an engaging portion, and a photosensitive member cartridge that accommodates the developing cartridge therein. The photosensitive member cartridge includes a photosensitive member, a frame that supports the photosensitive member, an accommodating portion that is provided in the frame and accommodates a developing cartridge including a developing agent carrier, a lever that is provided in the frame and movable between a contact position and a separation position, the lever maintains the developing agent carrier in contact with the photosensitive member when in the contact position, and maintains the developing agent carrier out of contact with the photosensitive member when in the separation position, and an urging member that urges the lever to the contact position.

With such a structure, the engaging portion of the developing cartridge engages the lever, and the lever moves between the contact position and the separation position, thereby the developing agent carrier and the photosensitive member are brought into contact with or separated from each other. This prevents the developing agent carrier from moving along with the photosensitive member cartridge. As a result, the developing agent carrier can be stably separated from the photosensitive member and a reliable separation can be achieved.

According to yet another exemplary aspect, an image forming apparatus includes a process unit; and a process unit accommodating portion that accommodates the process unit. The process unit includes a developing cartridge and a photosensitive member cartridge that accommodates the developing cartridge therein. The developing cartridge includes a developing agent carrier and an engaging portion. The photosensitive member cartridge includes a photosensitive member; a frame that supports the photosensitive member; a cartridge accommodating portion that is provided in the frame and accommodates the developing cartridge therein; and a lever that is provided in the frame and movable between a contact position and a separation position. The lever includes a receiving portion that receives the engaging portion so as to maintain the developing agent carrier in contact with the photosensitive member when in the contact position, and to maintain the developing agent carrier out of contact with the photosensitive member when in the separation position.

With such a structure, when the engaging portion of the developing cartridge is received in the receiving portion of the lever, the lever moves between the contact position and the separation position, thereby the developing agent carrier and the photosensitive member are brought into contact with or separated from each other. This prevents the developing agent carrier from moving along with the photosensitive member cartridge. As a result, the developing agent carrier can be stably separated from the photosensitive member and a reliable separation can be achieved.

The photosensitive member cartridge may include an urging member that urges the lever to the contact position. With such a structure, the lever is urged to the contact position by the urging member. As a result, the developing agent carrier and the photosensitive member can be brought in contact with each other in a normal condition.

The engaging portion of the developing cartridge may protrude from each side of the developing agent carrier with respect to a longitudinal direction thereof in a direction parallel to the longitudinal direction, and the lever may be provided on each side of the photosensitive member in the frame so as to engage with the corresponding engaging portion. With such a structure, as the levers are engaged with the corresponding engaging portions at the sides of the developing agent carrier with respect to the longitudinal direction thereof, a further reliable engagement of the lever with respect to the developing cartridge can be achieved.

The image forming apparatus may further include a pressing member that is provided in correspondence with the lever and presses the lever against an urging force by the urging member so that the lever is positioned in the separation position. With such a structure, the lever can be located in the separation position against the urging force of the urging member by the pressing member. Thus, the developing agent carrier and the photosensitive member can be separated from each other when necessary.

The pressing member may be movable between a pressing position where the pressing member presses the lever and a non-pressing position where the pressing member does not press the lever. With such, when the pressing member moves to the pressing position, the lever is pressed by the pressing member, and located in the separation position against the urging force of the urging member. In addition, when the pressing member moves to the non-pressing position, a pressure applied to the lever by the pressing member is released, and the lever is located in the contact position by the urging force of the urging member. Thus, with the move of the pressing member between the pressing position and the non-pressing position, the lever can be moved between the separation position and the contact position.

The pressing member may be a cam that is rotated by a drive force. When the pressing member is a cam, it can move between the pressing portion and the non-pressing portion in a fixed time period. The cam may include at least a first cam surface and a second cam surface. When the first cam surface contacts the lever, the lever may be positioned in the separation position. When the second cam surface contacts the lever, the lever may be located in the contact position. Thus, with a rotation of the cam, the lever can be moved between the separation position and the contact position in a fixed time period.

The image forming apparatus may further include another cam and a connecting member that connects the cams with the same phase. With such a structure, as the cams provided in correspondence with the respective levers are connected with the same phase by the connecting member, they can be rotated with the same phase.

The process unit may be inserted in the process unit accommodating portion along a direction perpendicular to a longitudinal direction of the photosensitive member. The pressing member may act on the lever at an operating point located upstream from the engaging portion received in the receiving portion with respect to a direction where the process unit is inserted. With such a structure, when the pressing member acts on the lever, the lever rotates around the engaging portion by a pressing force toward a downstream side with respect to the direction where the process unit is inserted. Thus, the developing cartridge can be reliably separated from the photosensitive member cartridge.

The image forming apparatus may further include a detector that detects whether the pressing member is located in the pressing position or the non-pressing position. With such, the pressing position and the non-pressing position of the pressing member can be detected by the detector. Thus, the contact and separation between the developing agent carrier and the photosensitive member can be detected.

The detector may include a light emitting portion, a light receiving portion, and a light-shielding plate that is disposed to the connecting member and passes between the light emitting portion and the light receiving portion. As such, the pressing position and the non-pressing position of the pressing member can be detected according to whether the light emitted from the light emitting portion and received at the light receiving portion is interrupted by the light-shielding plate.

When the pressing member is located in the pressing position, the light-shielding plate may be located between the light emitting portion and the light receiving portion to shield a light going from the light emitting portion toward the light receiving portion. With such a structure, when the pressing member is located in the pressing position, the light going from the light emitting portion toward the light receiving portion is interrupted by the light-shielding plate. Thus, the pressing position or the non-pressing position of the pressing member can be detected reliably.

The process unit may be inserted into the process unit accommodating portion along a direction perpendicular to a longitudinal direction of the photosensitive member. The cam can urge the lever in a direction where the process unit is inserted when the first cam surface contacts the lever. With such, the cam urges the lever in the direction where the process unit is inserted when the first cam surface contacts the lever. Thus, the lever can be reliably moved to the separation position.

The image forming apparatus may further include a driving portion that supplies a driving force to the connecting member; a determining device that determines an output of the detector; and a stop device that stops a supply of the driving force from the driving portion to the connecting member when the determining device determines that the pressing member is located in the pressing position. With such a structure, when the determining device determines that the pressing member is located in the non-pressing position, the stop device stops a supply of the driving force from the driving portion to the connecting member.

The image forming apparatus may further include a timekeeping device that starts measuring time when a process to stop the driving portion is started; and a force-terminating device that stops the supply of the driving force from the driving portion to the connecting member if the determining device does not determine that the pressing members are located in the pressing position even when a value counted by the timekeeping device exceeds a specified value. With such a structure, when a specified value is set as a time when the pressing member is sure to come to the non-pressing position, if the determining device determines that the value exceeds the specified value, it is regarded as an error. However, if such an error occurs, the force-terminating device stops the supply of the driving force from the driving portion to the connecting member, so that malfunction and damage to the apparatus can be prevented.

The image forming apparatus may further include a clutch that supplies and stops a driving force to the connecting member of the driving portion, wherein the stop device and the force-terminating device stop the supply of the driving force by engaging the clutch. With such a structure, as the clutch stops the supply of the driving force, the supply of the driving force can be stopped simply and reliably.

According to a further exemplary aspect, there is provided a developing cartridge detachably attached to a photosensitive member cartridge. The photosensitive member cartridge has a photosensitive member; a frame that supports the photosensitive member; an accommodating portion that is provided in the frame and accommodates a developing cartridge including a developing agent carrier; and a lever that is provided in the frame and movable between a contact position and a separation position. The lever maintains the developing agent carrier in contact with the photosensitive member when in the contact position. The lever maintains the developing agent carrier out of contact with the photosensitive member when in the separation position. The developing cartridge includes an engaging portion that is engageable with the lever.

With such a structure, when the lever provided in the frame of the photosensitive member cartridge is in engagement with the developing cartridge, the lever moves between the contact position and the separation position, whereby the developing agent carrier and the photosensitive member are brought into contact with or separated from each other. This prevents the developing agent carrier from moving along with the photosensitive member cartridge. As a result, the developing agent carrier can be stably separated from the photosensitive member, whereby a reliable separation can be achieved.

The engaging portion may protrude from each side of the developing agent carrier with respect to a longitudinal direction thereof and in a direction parallel to the longitudinal direction. As such, as the engaging portion engages the lever at each side of the developing agent carrier with respect to the longitudinal direction thereof, a further reliable engagement between the engaging portion and the lever can be achieved.

According to a yet further exemplary aspect, an image forming apparatus includes a process unit that is detachably attached to the image forming apparatus. The process unit includes a photosensitive member, a developing agent carrier, and a lever that is movable between a contact position at which the photosensitive member and the developing agent carrier are pressed into contact with each other and a separation position at which the photosensitive member and the developing agent carrier are separated from each other. The image forming apparatus further includes a frame that includes an accommodating portion that accommodates the process unit and an opening that communicates to the accommodating portion; a moving member that detachably engages with the lever and moves the lever between the contact position and the separation position; a cover that moves between a closed position that covers the opening and an open position that uncovers the opening; and an engagement releasing member that releases an engagement between the lever and the moving member along with a move of the cover from the closed position to the open position.

With such a structure, the lever is moved between the contact position and the separation position due to an engagement between the moving member and the lever, whereby the photosensitive member and the developing agent carrier can make contact with or separate from each other. When the cover is moved from the closed position to the open position to remove the process unit from the accommodating portion, the engagement releasing member releases the engagement between the lever and the moving member with the move of the cover. Thus, while the developing cartridge and the photosensitive member can make contact with or separate from each other, when the process unit is removed from the accommodating portion, even if the lever engages the moving member, the engagement therebetween can be released with the move of the cover from the closed position to the open position, and a smooth attaching and detaching of the process unit with respect to the accommodating portion can be achieved.

The process unit may include a photosensitive member cartridge having the photosensitive member, and a developing cartridge that is detachably attached to the photosensitive member cartridge and has the developing agent carrier. The photosensitive member cartridge may be provided with an engaging portion that engages with the lever. The photosensitive member cartridge may include an urging member that urges the lever to the contact position. With such a structure, as the lever, that engages the engaging portion of the developing cartridge, is urged to the contact position by the urging member, the developing agent carrier and the photosensitive member can be brought into contact with each other in a normal condition.

When the moving member and the lever remain engaged, the moving member may press the lever to the separation position against an urging force of the urging member. With such a structure, the lever can be moved to the separation position by the moving member against the urging force of the urging member. Thus, the developing agent carrier and the photosensitive member, which are brought into contact in the normal condition, can be separated from each other by the moving member when necessary.

The moving member may be movable between a pressing position where the moving member presses the lever and a non-pressing position where the moving member does not press the lever. As such, when the pressing member moves to the pressing position, the lever is pressed by the pressing member, and located in the separation position against the urging force of the urging member. In addition, when the pressing member moves to the non-pressing position, a pressure applied to the lever by the pressing member is released, and the lever is located in the contact position by the urging force of the urging member. Thus, with the move of the pressing member between the pressing position and the non-pressing position, the lever can be moved between the separation position and the contact position.

The moving member may be a cam that is rotated by a drive force. In such a structure, as the moving member is a cam, it can move between the pressing portion and the non-pressing portion in a fixed time period.

The cover may include an arm member rotatably supported to the frame. The engagement releasing member may include a contacting member that moves integrally with the moving member, and a releasing member that is provided to the arm member. The releasing member may make contact with the contacting member along with a move of the cover from the closed position to the open position, and may move the moving member from the pressing position to the non-pressing position. With such a structure, when the cover is moved from the closed position to the open position, the arm member rocks and the releasing member provided to the arm member makes contact with the contacting member. Thus, with a simple structure, the move of the cover from the closed position to the open position, and the move of the moving member from the pressing position to the non-pressing position can be reliably synchronized.

The moving member and the contacting member may be supported to a common shaft rotatably. With such a structure, as the moving member and the contacting member are supported to the common shaft rotatably, they can be reliably synchronized.

The image forming apparatus may further include a drive unit that transmits a drive force to rotate the moving member to the shaft; and a clutch that interrupts a transmission of the drive force to the shaft. With such a structure, when the process unit is removed from the accommodating portion, if the drive force transmitted from the drive unit to the shaft is interrupted by the clutch, the engagement releasing member and the contacting member make contact with each other, whereby the shaft can be rotated. Thus, the move of the moving member from the pressing position to the non-pressing position can be reliably secured.

The contacting member may include a projecting portion that is brought into contact with the releasing member. As such, the projection portion provided to the contacting portion can be brought into contact with the releasing member. Thus, the contacting member and the releasing member can reliably make contact with each other.

The releasing member may be provided at an upper end portion of the arm member, and be provided with a projecting portion that is brought into contact with the contacting member. With such a structure, the projecting portion provided to the releasing member can be brought into contact with the contacting member. Thus, the releasing member and the contacting member can reliably make contact with each other.

The moving member may be disposed to face a guide path formed between the accommodating portion and the opening in the frame. The moving member may protrude from the guide path when located in the pressing position. The moving member may be accommodated in the guide path when located in the non-pressing position.

With such a structure, when the moving member is located in the pressing position, it protrudes from the guide path to press the process unit, thereby preventing the process unit from moving toward the opening. When the moving member is located in the non-pressing position, it is accommodated in the guide path, thereby allowing the process unit to move toward the opening. Thus, the move of the process unit toward the opening can be prevented or allowed.

The process unit may be inserted via the guide path from the opening along a direction perpendicular to a longitudinal direction of the photosensitive member. The moving member may urge the lever in a direction where the process unit is inserted when located in the pressing position.

With such a structure, when the moving member is located in the pressing position, it urges the lever in the direction where the process unit is inserted. Thus, the move of the lever to the separation position by the pressing member can be reliably secured.

According to a further exemplary aspect of the invention, an image forming apparatus includes a main body frame. The main body frame includes a process unit detachably attached to the image forming apparatus; an accommodating portion that accommodates the process unit; an opening that communicates to the accommodating portion; and a guide portion that guides the process unit from the opening to the accommodating portion. The image forming apparatus further includes a moving member that moves between a first position at which the process unit is stopped to move in a direction toward the opening and a second position at which the process unit is allowed to move in the direction toward the opening when the process unit is inserted into the accommodating portion; a cover that moves between a closed position that covers the opening and an open position that releases the opening; and an actuator that moves the moving member from the first position to the second position along with a move of the cover from the closed position to the open position. With such a structure, when the cover is moved from the closed position to the open position, the actuator synchronously moves the moving member from the first position to the second position. Thus, the move of the process unit toward the opening can be allowed.

The process unit may include at least a photosensitive member and a process frame that supports the photosensitive member, and may be inserted into the accommodating portion via the guide portion from the opening along a direction perpendicular to a longitudinal direction of the photosensitive member. The moving member may be provided at each side of the photosensitive member with respect to a longitudinal direction thereof, and may protrude from the guide portion in the first position so as to press the process unit from below.

With such a structure, when the moving member is located in the first position, it protrudes from the guide portion so as to press the frame from below. Thus, the move of the process unit toward the opening can be prevented with the process unit placed in the accommodating portion.

The moving member may be a cam that is rotated by a drive force. As the moving member is a cam, it can move between the first position and the second position in a fixed time period.

The image forming apparatus may further include another cam and a connecting member that connects the cams with the same phase. Because the cams are connected with the same phase by the connecting member, they can be rotated with the same phase.

The cover may include an arm member rotatably supported to the main body frame. The actuator may include a contacting member that moves integrally with the moving member, and a releasing member that is provided in the arm member. The releasing member may make contact with the contacting member along with the move of the cover from the closed position to the open position, and move the moving member from the first position to the second position. With such a structure, when the cover is moved from the closed position to the open position, the releasing member provided to the arm member makes contact with the contacting member, and the moving member is moved from the first position to the second position integrally with the contacting member. Thus, with a simple structure, the moving member can be reliably moved from the first position to the second position.

The moving member and the contacting member may be supported to a common shaft and provided to be rotatable integrally with the shaft. As such, as the moving member and the contacting member are supported to the common shaft and provided such as to rotate integrally with the shaft, they can be reliably synchronized.

While the invention has been described with reference to an exemplary embodiment, the description of the exemplary embodiment is illustrative only and is not to be construed as limiting the scope of the invention. Various other modifications and changes may occur to those skilled in the art without departing from the spirit and scope of the invention.

What is claimed is:

1. A photosensitive member cartridge detachably attachable to a main body frame of an image forming apparatus, the photosensitive member cartridge comprising:

a photosensitive member;

a frame that supports the photosensitive member;

an accommodating portion that is provided in the frame and accommodates a developing cartridge; and a lever that is provided on each side of the photosensitive member in the frame and movable between a contact position and a separation position, the lever that maintains a developing agent carrier in contact with the photosensitive member when in the contact position, the lever that maintains the developing agent carrier out of contact with the photosensitive member when in the separation position, wherein the developing cartridge comprises:

a developing cartridge frame;

the developing agent carrier supported by the developing cartridge frame; and an engaging portion that protrudes from each side of the developing cartridge frame in a longitudinal direction of the developing agent carrier, wherein the lever is provided on each side of the photosensitive member in the frame so as to engage with the respective engaging portion when the lever is in the contact position.

2. The photosensitive member cartridge according to claim 1, further comprising an urging member that urges the lever to the contact position.

3. The photosensitive member cartridge according to claim 2, wherein the urging member is a spring.

4. The photosensitive member cartridge according to claim 1, wherein the lever includes a first receiving portion that receives an engaging portion provided in the developing cartridge, and the first receiving portion is formed in a groove that is open at one end with respect to a direction where the engaging portion is received.

5. The photosensitive member cartridge according to claim 4, wherein the first receiving portion has a substantially U-shape, and is formed with an inclined surface for guiding the engaging portion at an opening thereof.

6. The photosensitive member cartridge according to claim 4, wherein the first receiving portion is open upwardly.

7. The photosensitive member cartridge according to claim 4, wherein the frame includes a supporting member that supports the lever pivotally.

8. The photosensitive member cartridge according to claim 7, wherein the lever includes a second receiving portion that receives the supporting member, and the second receiving portion is formed in a groove that is open at one end with respect to a direction where the supporting member is received.

9. The photosensitive member cartridge according to claim 8, wherein the second receiving portion is open downwardly.

10. The photosensitive member cartridge according to claim 1, wherein the frame includes a guide member that is guided to the main body frame of the image forming apparatus when the photosensitive member cartridge is attached thereto.

11. A process unit, comprising:

a developing cartridge that includes a developing agent carrier and an engaging portion, wherein the engaging portion of the developing cartridge protrudes from each side of the developing agent carrier with respect to a longitudinal direction thereof in a direction parallel to the longitudinal direction; and a photosensitive member cartridge that accommodates the developing cartridge therein, the photosensitive member cartridge comprising:

a photosensitive member;

a frame that supports the photosensitive member;

an accommodating portion that is provided in the frame and accommodates a developing cartridge including a developing agent carrier;

a lever that is provided in the frame and movable between a contact position and a separation position, the lever that maintains the developing agent carrier in contact with the photosensitive member when in the contact position, the lever that maintains the developing agent carrier out of contact with the photosensitive member when in the separation position and the lever is provided on each side of the photosensitive member in the frame so as to engage with the corresponding engaging portion; and an urging member that urges the lever to the contact position.

12. An image forming apparatus, comprising a process unit; and a process unit accommodating portion that accommodates the process unit, the process unit that includes a developing cartridge and a photosensitive member cartridge that accommodates the developing cartridge therein, the developing cartridge including a developing agent carrier and an engaging portion; and the photosensitive member cartridge comprising:

a photosensitive member, wherein the photosensitive member cartridge includes an urging member that urges the lever to the contact position;

a frame that supports the photosensitive member;

a cartridge accommodating portion that is provided in the frame and accommodates the developing cartridge therein; and a lever that is provided in the frame and movable between a contact position and a separation position, the lever including a receiving portion that receives the engaging portion so as to maintain the developing agent carrier in contact with the photosensitive member when in the contact position, and to maintain the developing agent carrier out of contact with the photosensitive member when in the separation position; and a pressing member that is provided in correspondence with the lever and presses the lever against an urging force by the urging member so that the lever is positioned in the separation position.

13. The image forming apparatus according to claim 12, wherein the engaging portion of the developing cartridge protrudes from each side of the developing agent carrier with respect to a longitudinal direction thereof in a direction parallel to the longitudinal direction, and the lever is provided on each side of the photosensitive member in the frame so as to engage with the corresponding engaging portion.

14. The image forming apparatus according to claim 12, wherein the pressing member is movable between a pressing position where the pressing member presses the lever and a non-pressing position where the pressing member does not press the lever.

15. The image forming apparatus according to claim 14, further comprising a detector that detects whether the pressing member is located in the pressing position or the non-pressing position.

16. The image forming apparatus according to claim 15, wherein the detector includes a light emitting portion, a light receiving portion, and a light-shielding plate that is disposed to the connecting member and passes between the light emitting portion and the light receiving portion.

17. The image forming apparatus according to claim 16, wherein when the pressing member is located in the pressing position, the light-shielding plate is located between the light emitting portion and the light receiving portion to shield a light going from the light emitting portion toward the light receiving portion.

18. The image forming apparatus according to claim 15, further comprising:

a driving portion that supplies a driving force to the connecting member;

a determining device that determines an output of the detector; and a stop device that stops a supply of the driving force from the driving portion to the connecting member when the determining device determines that the pressing member is located in the pressing position.

19. The image forming apparatus according to claim 18, further comprising:

a timekeeping device that starts measuring time when a process to stop the driving portion is started; and a force-terminating device that stops the supply of the driving force from the driving portion to the connecting member if the determining device does not determine that the pressing members are located in the pressing position even when a value counted by the timekeeping device exceeds a specified value.

20. The image forming apparatus according to claim 18, further comprising a clutch that supplies and stops a driving force to the connecting member of the driving portion, wherein the stop device and the force-terminating device stop the supply of the driving force by engaging the clutch.

21. The image forming apparatus according to claim 12, wherein the pressing member is a cam that is rotated by a drive force.

22. The image forming apparatus according to claim 21, wherein the cam has at least a first cam surface and a second cam surface, and when the first cam surface contacts the lever, the lever is positioned in the separation position.

23. The image forming apparatus according to claim 22, wherein the process unit is inserted into the process unit accommodating portion along a direction perpendicular to a longitudinal direction of the photosensitive member, and the cam urges the lever in a direction where the process unit is inserted when the first cam surface contacts the lever.

24. The image forming apparatus according to claim 21, further comprising:

another cam; and a connecting member that connects the cams with the same phase.

25. The image forming apparatus according to claim 12, wherein the process unit is inserted in the process unit accommodating portion along a direction perpendicular to a longitudinal direction of the photosensitive member, and the pressing member acts on the lever at an operating point located upstream from the engaging portion received in the receiving portion with respect to a direction where the process unit is inserted.

26. A developing cartridge detachably attachable to a photosensitive member cartridge, the photosensitive member cartridge comprising:

a photosensitive member;

a frame that supports the photosensitive member;

an accommodating portion that is provided in the frame and accommodates the developing cartridge; and a lever that is provided on each side of the photosensitive member cartridge in the frame and movable between a contact position and a separation position, the lever that maintains a developing agent carrier in contact with the photosensitive member when in the contact position, the lever that maintains the developing agent carrier out of contact with the photosensitive member when in the separation position, the developing cartridge comprising:

a developing cartridge frame;

a developing agent carrier supported by the developing cartridge frame; and an engaging portion that protrudes from each side of the developing cartridge frame in a longitudinal direction of the developing agent carrier so that the lever engages with the respective engaging portion when the lever is in the contact position.

27. An image forming apparatus, comprising:

a process unit that is detachably attached to the image forming apparatus, the process unit comprising:

a photosensitive member;

a developing agent carrier; and a lever that is movable between a contact position at which the photosensitive member and the developing agent carrier are pressed in contact with each other and a separation position at which the photosensitive member and the developing agent carrier are separated from each other;

a frame that includes an accommodating portion that accommodates the process unit and an opening that communicates to the accommodating portion;

a moving member that detachably engages with the lever and moves the lever between the contact position and the separation position;

a cover that moves between a closed position that covers the opening and an open position that uncovers the opening; and an engagement releasing member that releases an engagement between the lever and the moving member along with a move of the cover from the closed position to the open position.

28. The image forming apparatus according to claim 27, wherein the process unit includes a photosensitive member cartridge having the photosensitive member, and a developing cartridge that is detachably attached to the photosensitive member cartridge and has the developing agent carrier, the photosensitive member cartridge is provided with the lever, the developing cartridge is provided with an engaging portion that engages with the lever, and the photosensitive member cartridge includes an urging member that urges the lever to the contact position.

29. The image forming apparatus according to claim 28, wherein when the moving member and the lever remain engaged, the moving member presses the lever to the separation position against an urging force of the urging member.

30. The image forming apparatus according to claim 29, wherein the moving member is movable between a pressing position where the moving member presses the lever and a non-pressing position where the moving member does not press the lever.

31. The image forming apparatus according to claim 30, wherein the moving member is a cam that is rotated by a drive force.

32. The image forming apparatus according to claim 30, wherein the cover includes an arm member rotatably supported to the frame, and the engagement releasing member includes a contacting member that moves integrally with the moving member, and a releasing member that is provided to the arm member, and the releasing member makes contact with the contacting member along with a move of the cover from the closed position to the open position, and moves the moving member from the pressing position to the non-pressing position.

33. The image forming apparatus according to claim 32, wherein the moving member and the contacting member are supported to a common shaft rotatably.

34. The image forming apparatus according to claim 33, further comprising:

a drive unit that transmits a drive force to rotate the moving member to the shaft; and a clutch that interrupts a transmission of the drive force to the shaft.

35. The image forming apparatus according to claim 32, wherein the contacting member includes a projecting portion that is brought into contact with the releasing member.

36. The image forming apparatus according to claim 32, wherein the releasing member is provided at an upper end portion of the arm member, and is provided with a projecting portion that is brought into contact with the contacting member.

37. The image forming apparatus according to claim 30, wherein the moving member is disposed to face a guide path formed between the accommodating portion and the opening in the frame, the moving member protrudes from the guide path when located in the pressing position, and the moving member is accommodated in the guide path when located in the non-pressing position.

38. The image forming apparatus according to claim 37, wherein the process unit is inserted into the accommodating portion via the guide path from the opening along a direction perpendicular to a longitudinal direction of the photosensitive member, and the moving member urges the lever in a direction where the process unit is inserted when located in the pressing position.

39. An image forming apparatus, comprising:

a main body frame including:

a process unit detachably attached to the image forming apparatus;

an accommodating portion that accommodates the process unit;

an opening that communicates to the accommodating portion; and a guide portion that guides the process unit from the opening to the accommodating portion;

a moving member that moves between a first position at which the process unit is stopped to move in a direction toward the opening and a second position at which the process unit is allowed to move in the direction toward the opening when the process unit is inserted into the accommodating portion;

a cover that moves between a closed position that covers the opening and an open position that releases the opening; and an actuator that moves the moving member from the first position to the second position along with a move of the cover from the closed position to the open position.

40. The image forming apparatus according to claim 39, wherein the process unit includes at least a photosensitive member and a process frame that supports the photosensitive member, and is inserted into the accommodating portion via the guide portion from the opening along a direction perpendicular to a longitudinal direction of the photosensitive member, and the moving member is provided at each side of the photosensitive member with respect to a longitudinal direction thereof, and protrudes from the guide portion in the first position so as to press the frame from below.

41. The image forming apparatus according to claim 40, wherein the moving member is a cam that is rotated by a drive force.

42. The image forming apparatus according to claim 41, further comprising:

another cam; and a connecting member that connects the cams with the same phase.

43. The image forming apparatus according to claim 39, wherein the cover includes an arm member supported to the main body frame rotatably, and the actuator includes a contacting member that moves integrally with the moving member, and a releasing member that is provided in the arm member, and the releasing member makes contact with the contacting member along with the move of the cover from the closed position to the open position, and moves the moving member from the first position to the second position.

44. The image forming apparatus according to claim 43, wherein the moving member and the contacting member are supported to a common shaft and provided to be rotatable integrally with the shaft.

* * * * *